US007438389B2

(12) United States Patent
Katayama

(10) Patent No.: US 7,438,389 B2
(45) Date of Patent: Oct. 21, 2008

(54) INKJET HEAD

(75) Inventor: Naoki Katayama, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 372 days.

(21) Appl. No.: 11/212,418

(22) Filed: Aug. 26, 2005

(65) Prior Publication Data

US 2006/0044363 A1 Mar. 2, 2006

(30) Foreign Application Priority Data

Aug. 27, 2004 (JP) ..... 2004-247713

(51) Int. Cl.
*B41J 2/14* (2006.01)
*B41J 2/045* (2006.01)

(52) U.S. Cl. ..... 347/50; 347/71

(58) Field of Classification Search ..... 347/50, 347/68–72

See application file for complete search history.

(56) References Cited

U.S. PATENT DOCUMENTS 6,241,346 B1 * 6/2001 Takahashi ..... 347/70
6,270,193 B1 * 8/2001 Hiwada ..... 347/50
6,532,028 B1 3/2003 Gailus et al.
2003/0156157 A1 8/2003 Suzuki et al.

FOREIGN PATENT DOCUMENTS

| | | |
|---|---|---|
| EP | 0 813 968 | 12/1997 |
| EP | 1 336 491 | 8/2003 |
| JP | 2003311953 | 11/2003 |

* cited by examiner

*Primary Examiner*—Stephen D Meier
*Assistant Examiner*—Geoffrey Mruk
(74) *Attorney, Agent, or Firm*—Reed Smith LLP

(57) ABSTRACT

An inkjet head includes a flat cable having: (a) first drive wires connecting first output terminals and a first driver circuit; (b) first controller wires extending from the first driver circuit; (c) second drive wires connecting second output terminals and a second driver circuit; and (d) second controller wires extending from the second driver circuit. The output terminals includes (i) a terminal which is most distant from the first driver circuit among the output terminals and which is one of the second output terminals, and/or (ii) a terminal which is most distant from the second driver circuit among the output terminals and which is one of the first output terminals. The first controller wires extend from the first driver circuit toward one of opposite sides of the second driver circuit that is remote from the first driver circuit.

13 Claims, 16 Drawing Sheets

INKJET HEAD

This application is based on Japanese Patent Application No. 2004-247713 filed on Aug. 27, 2004, the content of which is incorporated hereinto by reference.

BACKGROUND OF THE INVENTION

1. Field of the Invention

The present invention relates to an inkjet head operable to eject an ink onto a recording medium, for performing a printing operation on the recording medium.

2. Discussion of Related Art

There is known an inkjet head arranged, for example, in a printer, to distribute an ink supplied from an ink tank, into a plurality of pressure chambers, and to generate a drive signal in the form of a pulse train for applying a pressure to the ink stored in a selected one or ones of the pressure chambers, so that the ink is ejected through nozzle or nozzles which are held in communication with the selected pressure chamber or chambers. As means for applying the pressure to the ink stored in the selected pressure chamber or chambers, there is known an actuator unit provided by a laminar structure including a plurality of piezoelectric sheets each of which is made of a piezoelectric ceramic.

As an example of the inkjet head, U.S. Patent Application Publication No. US 2003/0156157 A1 (corresponding to JP-A-2003-311953) discloses an inkjet head equipped with an actuator unit including a common electrode, a plurality of individual electrodes and a piezoelectric sheet interposed between the common electrode and the individual electrodes. The common electrode is formed to straddle a plurality of pressure chambers. Each of the individual electrodes is provided by a main portion and an auxiliary portion which are contiguous to each other, such that the main portion is positioned to be opposed to a corresponding one of the pressure chambers, while the auxiliary portion is arranged to receive an electric voltage applied from an exterior of the inkjet head. The piezoelectric sheet has active portions each of which is interposed between the common electrode and a corresponding one of the individual electrodes so as to be polarizable in a thickness or lamination direction of the piezoelectric sheet. In operation of the inkjet head, when a predetermined level of voltage is applied between each individual electrode and the common electrode as a result of supply of a drive voltage from a flexible printed circuit (FPC), the corresponding active portion of the piezoelectric sheet is made to expand or contract in the lamination direction due to a longitudinal piezoelectric effect. The deformation of the active portion causes a volume of the corresponding pressure chamber to be changed, whereby the ink stored in the pressure chamber is pressurized to be ejected through the corresponding nozzle (which is held in communication with the pressure chamber) toward a recording medium. In the flexible printed circuit which is attached to the actuator unit, a plurality of connection pads (terminals) are provided to be connected to the individual electrodes, and drive wires are provided to connect the connection pads and output terminals of a driver IC which is operable to generate a drive voltage that is to be supplied to each of the individual electrodes.

In the inkjet head as described above, where the plurality of pressure chambers are arranged with a higher density for attending a need for improvement in printing quality and also a need for reduction in size of the inkjet head, the auxiliary portions of the individual electrodes corresponding to the plurality of pressure chambers are also necessarily disposed on the piezoelectric sheet with a higher density. The individual electrodes require to be connected at their auxiliary portions to the drive wires, through each of which the drive voltage is to be supplied to the corresponding individual electrode. There is a limitation with respect to density of the drive wires which are formed to extend from the respective connection pads in the same direction on the flexible printed circuit. It might be possible to arrange the drive wires on a plurality of flexible printed circuits rather than a single flexible printed circuit. However, this arrangement leads to an increase in a total area of the flexible printed circuits and accordingly an increase in its manufacturing cost.

SUMMARY OF THE INVENTION

The present invention was made in view of the background prior art discussed above. It is therefore an object of the invention to provide an inkjet head in which wires can be formed to be arranged at an increased pitch on a flat cable such as a flexible printed circuit having a reduced area. This object may be achieved according to a principle of the present invention, which provides an inkjet head including: (a) a passage defining unit having a plurality of nozzles and a plurality of pressure chambers held in communication with the nozzles; (b) an actuator unit superposed on the passage defining unit and having a plurality of lands, such that the actuator unit is operable based on a drive signal supplied to each of the plurality of lands, to apply an ejection energy to an ink stored in a corresponding one of the pressure chambers of the passage defining unit; (c) first and second driver circuits each having (c-1) a plurality of control signal terminals and (c-2) a plurality of drive signal terminals, such that a control signal can be input to each of the control signal terminals, and such that the drive signal generated based on the control signal can be output from each of the drive signal terminals; and (d) a flat cable on which the first and second driver circuits are disposed. The flat cable has: a plurality of output terminals connected to the lands and located between the first and second driver circuits, the output terminals being grouped into first output terminals and second output terminals; (d-2) first drive wires connecting the first output terminals and the drive signal terminals of the first driver circuit; (d-3) first controller wires extending from the control signal terminals of the first driver circuit; (d-4) second drive wires connecting the second output terminals and the drive signal terminals of the second driver circuit; and (d-5) second controller wires extending from the control signal terminals of the second driver circuit. The output terminals includes (i) a terminal which is most distant from the first driver circuit among the output terminals and which is one of the second output terminals, and/or (ii) a terminal which is most distant from the second driver circuit among the output terminals and which is one of the first output terminals. The first controller wires extend from the control signal terminals of the first driver circuit toward one of opposite sides of the second driver circuit that is remote from the first driver circuit.

In the present inkjet head, the pitch between each adjacent pair of the wires can be increased while the area of the flat cable can be reduced, thereby making it possible to reduce a cost required to manufacture the flat cable. Further, since the output terminals are located between the first and second driver circuits, thermal influences of the first and second driver circuits upon the actuator unit and the passage defining unit can be substantially equalized.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENTS

First Embodiment

<Construction of Head>

Figure 1:
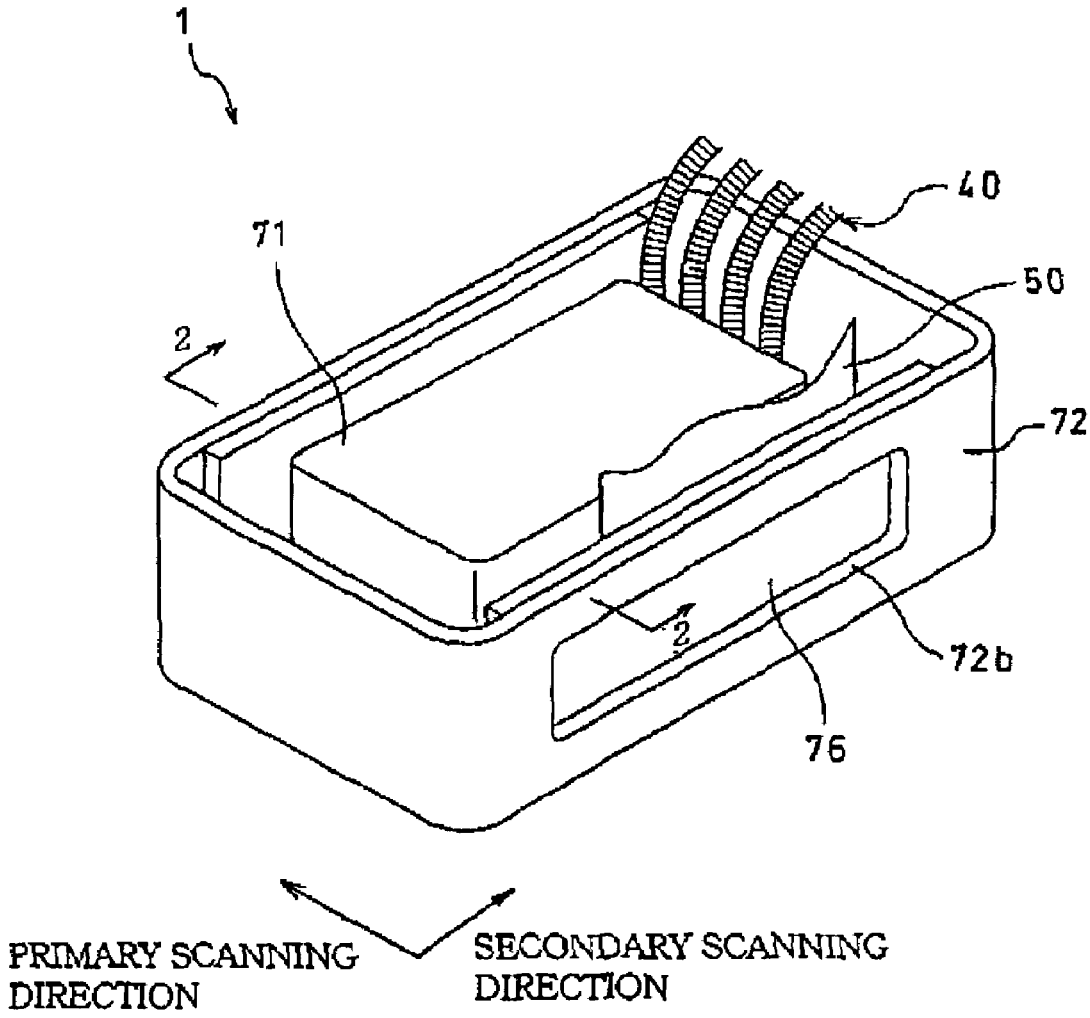
FIG. 1 is a perspective view of an inkjet head constructed according to a first embodiment of the invention.
Figure 2:
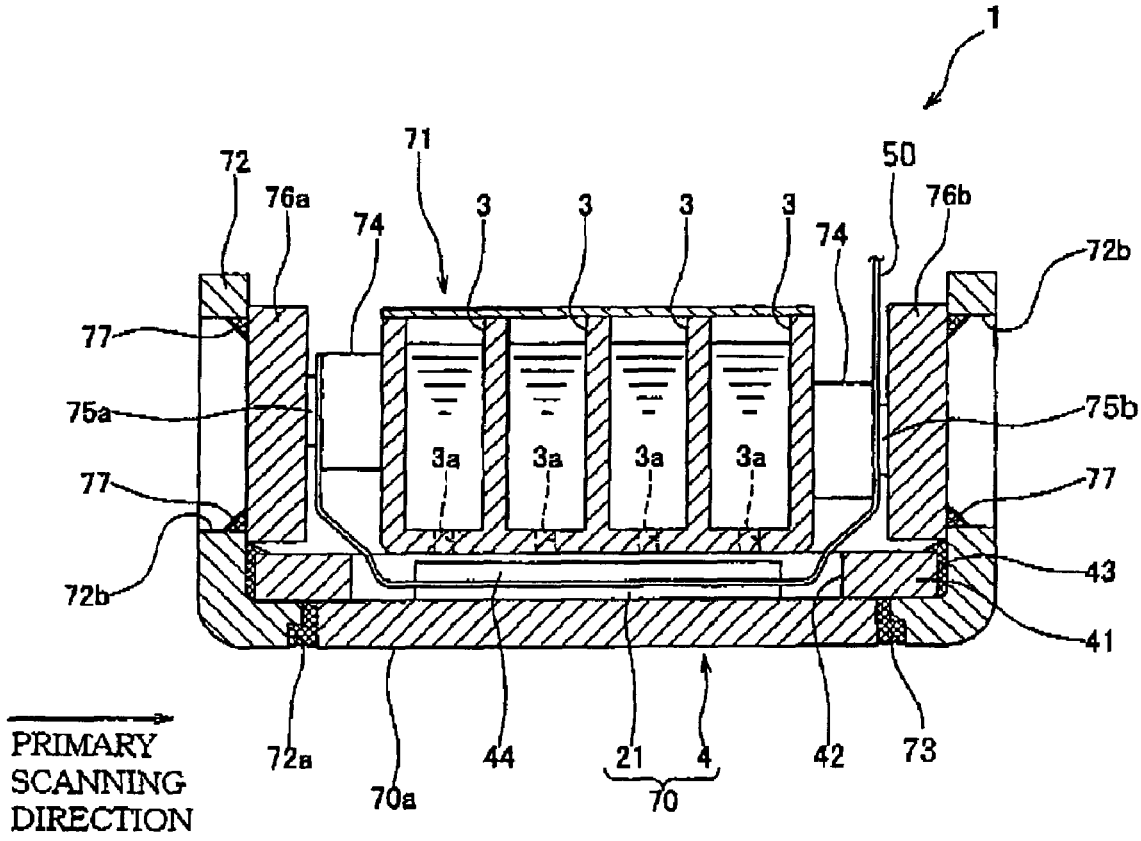
FIG. 2 is a cross sectional view taken along line 2-2 of FIG. 1.

Referring first to FIGS. 1-13, there will be described an inkjet head 1 constructed according to a first embodiment of the invention. This inkjet head unit 1 is to be installed on an inkjet printer of serial type (not shown), so as to be operable to perform a recording operation, by ejecting four color inks (e.g., magenta, yellow, cyan and black inks) toward a paper sheet which is fed in a secondary scanning direction. As shown in FIGS. 1 and 2, the inkjet head 1 includes an ink tank 71 which defines therein four ink chambers 3 storing the respective four color inks, and a main body 70 which is located below the ink tank 71.

Figure 3:
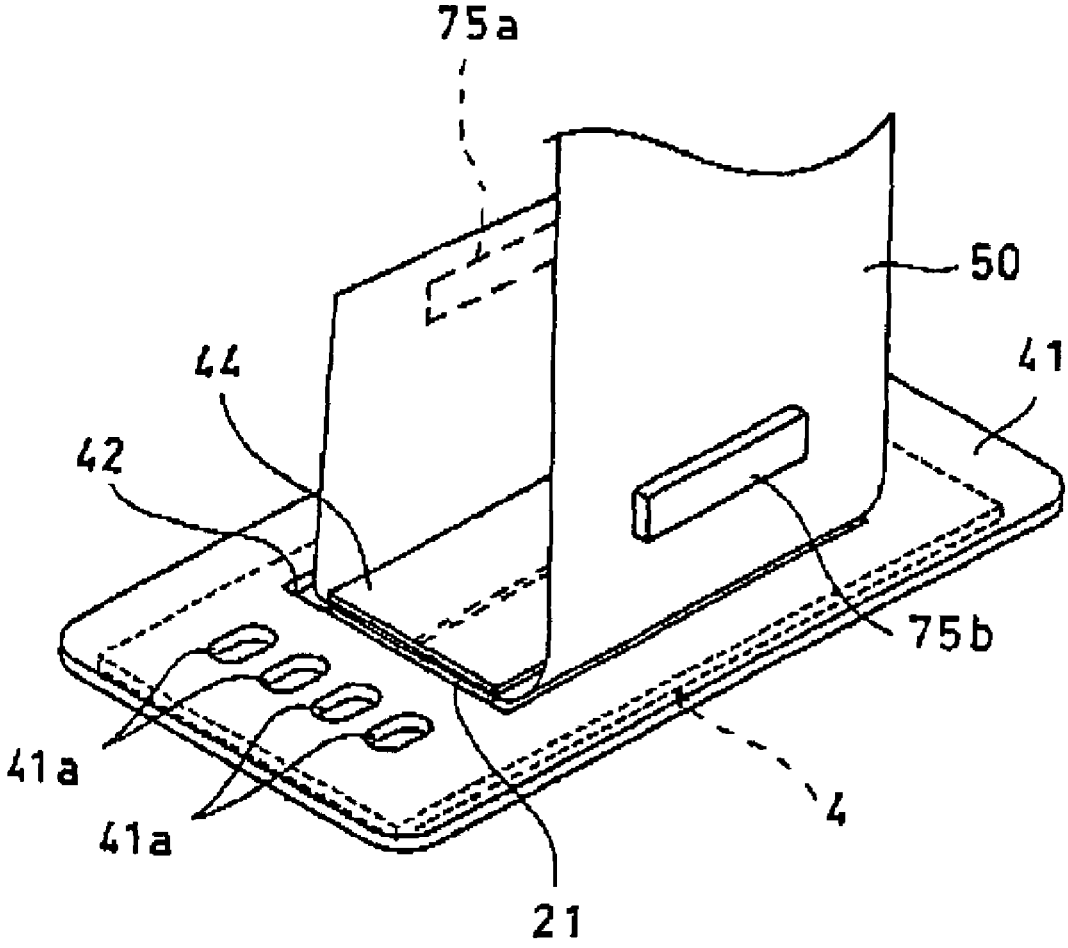
FIG. 3 is a perspective view showing a state in which a reinforcement plate is bonded to a main body of the inkjet head of FIG. 1.

The ink chambers 3 defined in the ink tank 71 is arranged in a primary scanning direction that is perpendicular to the secondary scanning direction. The black, cyan, yellow and magenta color inks are stored in the leftmost, second leftmost, second rightmost and rightmost chambers 3, respectively, as seen in FIG. 2. The four ink chambers 3 are connected to respective ink cartridges (not shown) via tubes 40 (see FIG. 1), so that the color inks are suppliable to the ink chambers 3 from the ink cartridges via the tubes 40. As shown in FIG. 2, the ink tank 71 is fixed to a generally rectangular reinforcement plate 41, which has an opening 42 having a rectangular shape in its plan view (see FIG. 3). The main body 70 of the inkjet head 1 is bonded to be fixed to the reinforcement plate 41, such that an actuator unit 21 of the main body 70 is located in the opening 42. The reinforcement plate 41 is fixed to a generally rectangular parallelepiped-shaped holder 72 by an ultraviolet curing agent 43, such that the ink tank 71 and the main body 70 of the inkjet head 1 are located on upper and lower sides of the reinforcement plate 41, respectively. The ink tank 71 has four ink outlets 3*a* formed through its bottom wall (see FIG. 2), so that the ink is suppliable from each of the four ink chambers 3 through the corresponding ink outlet 3*a*. The reinforcement plate 41 has four through-holes 41*a* each having a generally elliptic shape in the plan view, as shown in FIG. 3. The four through-holes 41*a* are held in communication with the respective ink outlets 3*a* of the ink tank 71.

Figure 6:
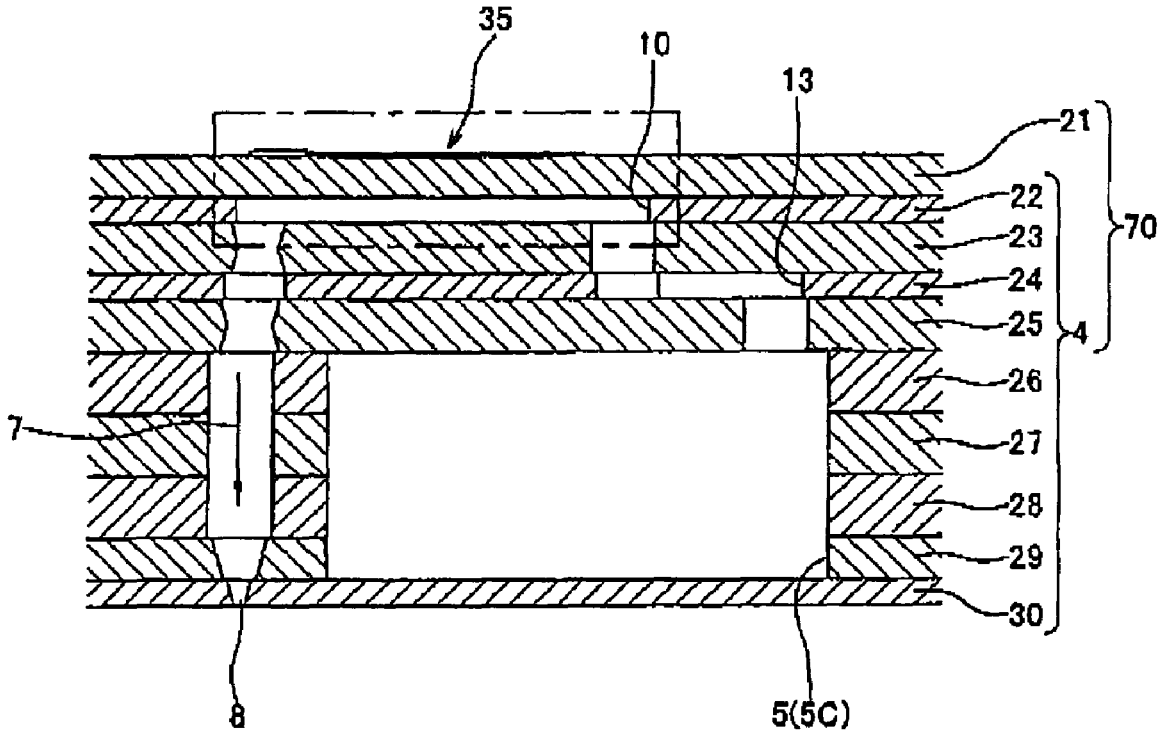
FIG. 6 is a cross sectional view taken along line 6-6 of FIG. 5.

The main body 70 of the inkjet head 1 includes an ink-passage defining unit 4 defining therein a plurality of ink passages which constitute four ink channels corresponding to the four ink colors, and the above-described actuator unit 21 bonded to an upper surface of the ink-passage defining unit 4 by a thermosetting epoxy resin. As shown in FIGS. 6 and 7, the passage defining unit 4 and the actuator unit 21 are laminar structures each of which includes a plurality of thin sheets superposed on each other. The main body 70 including the ink-passage defining unit 4 and the actuator unit 21 is fixed to the reinforcement plate 41 and is located below the ink tank 71. Four ink inlets 4*a*, each having a generally elliptic shape in the plan view, open in the upper surface of the ink-passage defining unit 4 (see FIG. 4). The ink-passage defining unit 4 is bonded to the reinforcement plate 41 such that the ink inlets 4*a* of the ink-passage defining unit 4 are opposed to or aligned with the respective through-holes 41*a* of the reinforcement plate 41, as shown in FIG. 3. Owing to this construction, the four color inks can be supplied through the respective four ink inlets 4*a* into the ink-passage defining unit 4, after passing through the respective four ink outlets 3*a* of the ink tank 71 and the respective four through-holes 41*a* of the reinforcement plate 41.

The reinforcement plate 41 is bonded to an inside surface of a bottom wall of the holder 72, as shown in FIG. 2, such that a nozzle defining surface 70*a* of the ink-passage defining unit 4 is exposed to an exterior of the inkjet head unit 1, through an aperture 72*a* of the holder 72 which is formed through the bottom wall of the holder 72 and which is defined or surrounded by a stepped surface of the bottom wall of the holder 72. A sealer 73 is interposed between the holder 72 and the ink-passage defining unit 4 which is received in the aperture 72*a* of the holder 72. A multiplicity of nozzles 8 (see FIG. 6) each having a micro diameter are arranged in the nozzle defining surface 70*a*, which corresponds to a bottom wall of the main body 70 of the inkjet head 1. A power supplier in the form of a flexible printed circuit (FPC) 60 as a flat cable is connected to an upper surface of the actuator unit 21. Further, a protector plate 44 is bonded to an upper surface of the FPC 50, as shown in FIG. 2, for protecting the FPC 50 and the actuator unit 21 and also minimizing temperature variation among portions of the actuator units 21.

A first driver IC 75*a* as a first driver circuit and a second driver IC 75*b* as a second driver circuit are disposed on respective portions on the FPC 50. As shown in FIG. 2, the portions of the FPC 50 extend upwardly from the upper surface of the actuator unit 21 along side surfaces of the ink tank 71 which are opposed to each other, such that the first and second driver ICs 75*a*, 75*b* are held in parallel to the respective side surfaces of the ink tank 71. The FPC 50 has a portion which is located one of opposite sides of the second driver IC 75*b* that is remote from the first driver IC 75*a*, and which extends toward a controller (not shown) disposed outside the inkjet head 1. The FPC 50 is electrically connected to the first and second driver ICs 75*a*, 75*b* by soldering, such that drive signals output from the first and second driver ICs 75*a*, 75*b* can be transmitted to the actuator unit 21 of the main body 70 of the inkjet head 1. The above-described portions of the FPC 50, in which the first and second driver ICs 75*a*, 75*b* are disposed, are fixed to the respective side surfaces of the ink tank 71 through respective elastic members 74 such as sponges.

Apertures 72*b* are formed through side walls of the holder 72 which are opposed to the respective the first and second driver ICs 75*a*, 75*b*, such that heat generated by the driver ICs 75*a*, 75*b* can be dissipated through the apertures 72*b* to the exterior of the inkjet head 1. Between the first driver IC 75*a* and the aperture 72*b* of the holder 72, there is disposed a heat sink 76*a* which is provided by a generally rectangular parallelepiped-shaped aluminum plate. Between the second driver IC 75*b* and the aperture 72*b* of the holder 72, there is disposed another heat sink 76*b* which is also provided by a generally rectangular parallelepiped-shaped aluminum plate. The first and second driver ICs 75*a*, 75*b* are forced by the respective elastic members 74, against the respective heat sinks 76*a*, 76*b*. In this arrangement with the heat sinks 76*a*, 76*b* and the apertures 72*b*, the heat generated by the driver ICs 75*a*, 75*b* can be efficiently dissipated. A gap between each of the side walls of the holder 72 and a corresponding one of the heat sinks 76*a*, 76*b* is filled with a sealer 77, which is provided within a corresponding one of the apertures 72*b* for preventing dust or ink from entering the inkjet head 1.

Figure 4:
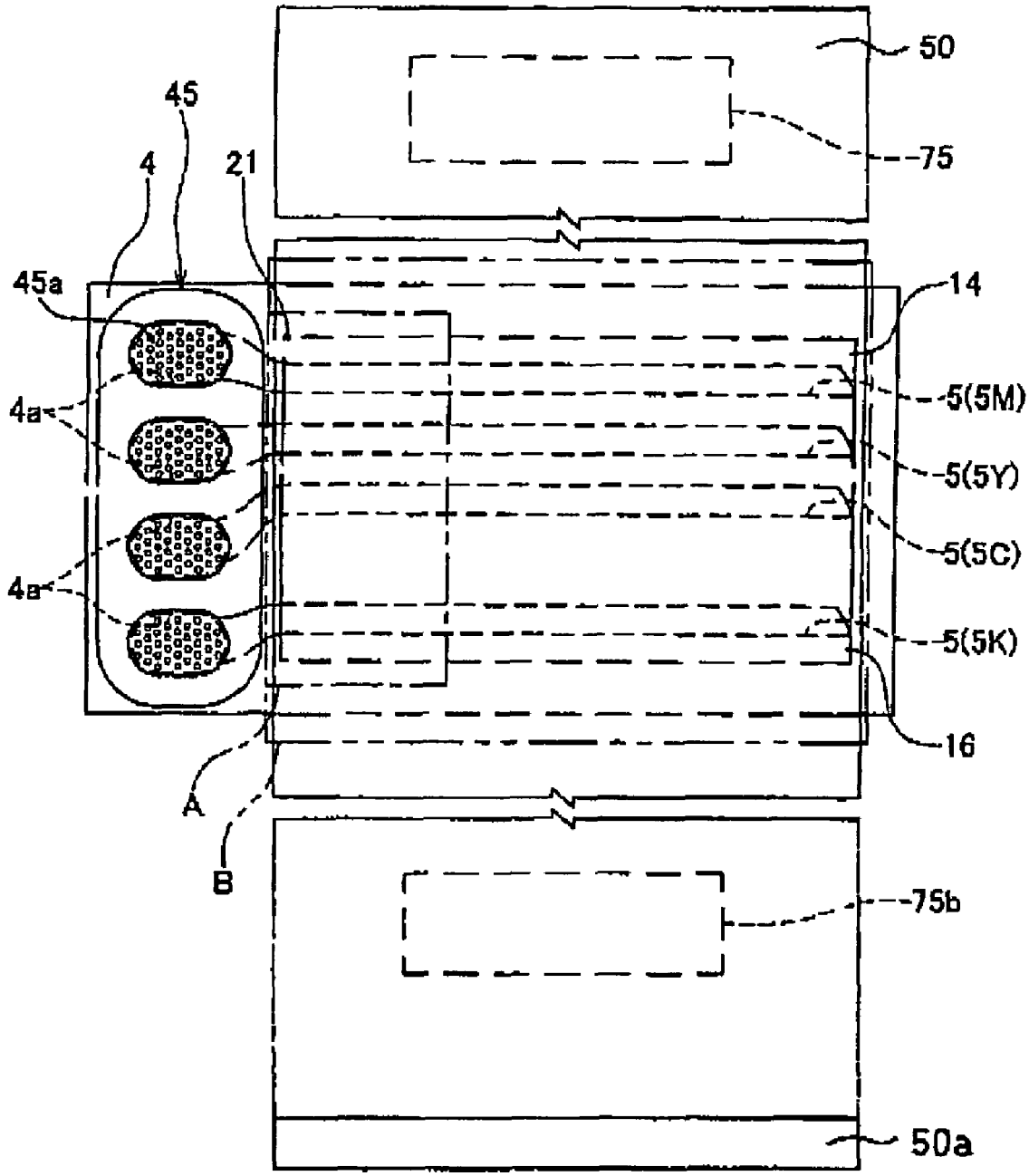
FIG. 4 is a plan view of the main body of the inkjet head of FIG. 1.

As shown in FIG. 4 which is a plan view of the main body 70 of the inkjet head 1, the main body 70 has in it plan view a substantially rectangular shape which is elongated in the above-described secondary scanning direction. The ink-passage defining unit 4 defines therein four manifold passages (common chambers) 5 which are parallel to each other and elongated in the secondary scanning direction. To the manifold passages 5, the respective color inks are supplied from the respective ink chambers 3 of the ink tank 71 via the respective four ink inlets 4*a* of the ink-passage defining unit 4. In the present embodiment, the magenta, yellow, cyan and black color inks are supplied into the uppermost, second uppermost, second lowermost and lowermost manifold passages 5M, 5Y, 5C, 5K, respectively, as seen in FIG. 4. Among the four manifold passages 5M, 5Y, 5C, 5K, three manifold passages 5M, 5Y, 5C are arranged at a constant spacing interval as viewed in the above-described primary scanning direction (i.e., width direction of the ink-passage defining unit 4). Meanwhile, the lowermost manifold passage 5K is located to be spaced apart from the second lowermost manifold passage 5C by a distance larger than the above-described spacing distance. Further, as shown in FIG. 4, a filter plate 45 is disposed on a portion of the upper surface of the ink-passage defining unit 4 in which the ink inlets 4*a* are located, so as to cover the ink inlets 4*a*. The filter plate 45 has porous portions 45*a* which overlap with the respective ink inlets 4*a* and which have a plurality of micro holes or pores, so as to allow flow of the inks from the ink tank 71 into the ink-passage defining unit 4 while capturing dust or other foreign matters contained in the inks.

Figure 5:
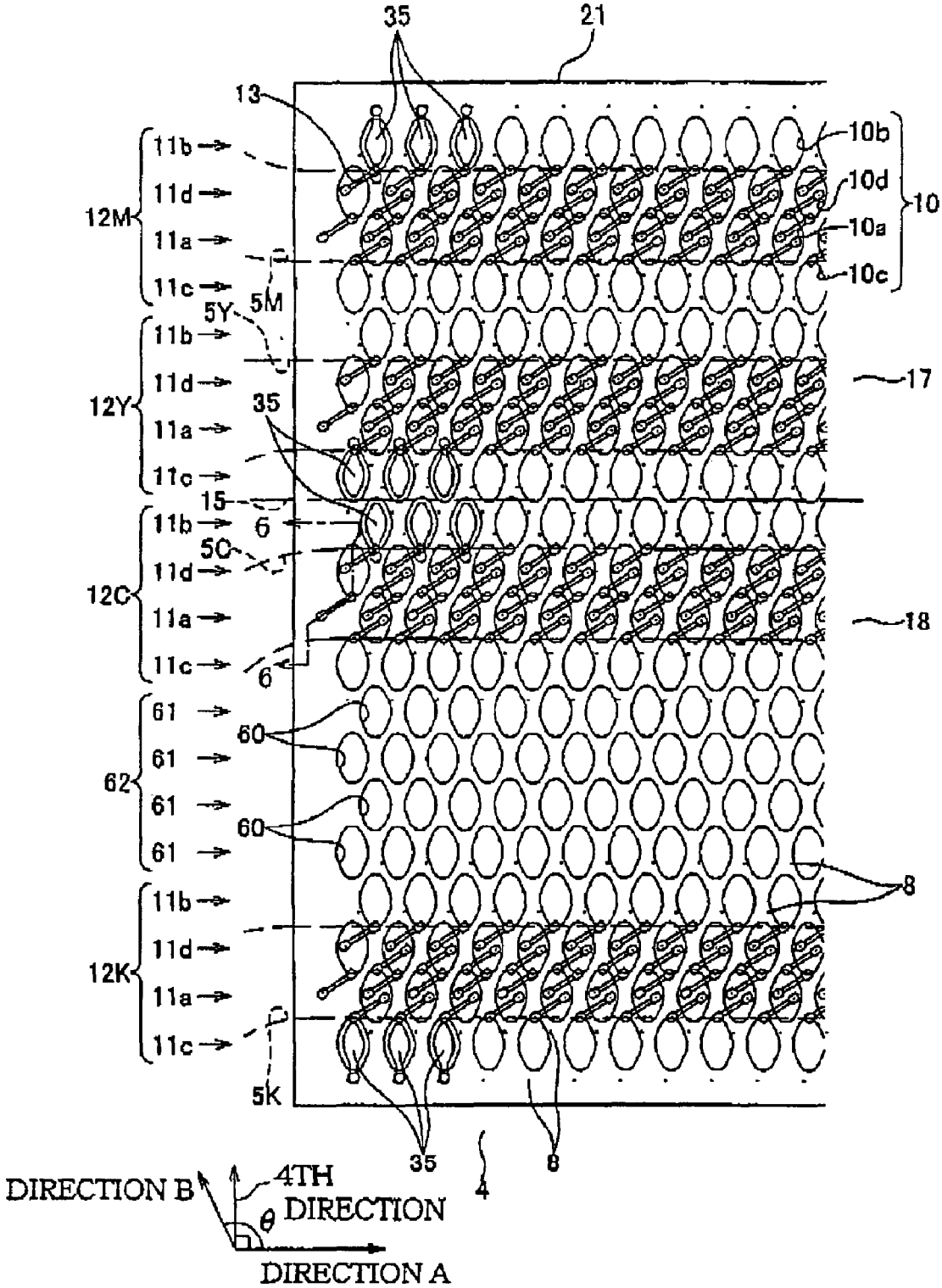
FIG. 5 is an enlarged view of a portion of the main body of the inkjet head of FIG. 1, which portion is surrounded by one-dot chain line in FIG. 4.

The actuator unit 21, having an oblong rectangular shape in the plan view, is bonded to substantially a central portion of the upper surface of the ink-passage defining unit 4, which portion is distant from the ink inlets 4*a*. The multiplicity of nozzles 8 are arranged in an ink ejection portion of the lower surface (nozzle defining surface 70*a*) of the ink-passage defining unit 4, which portion underlies the central portion of the upper surface of the unit 4. In the central portion of the upper surface of the unit 4 to which the actuator unit 21 is bonded, a multiplicity of pressure chambers 10 and dummy chambers (voids) 60 are formed to be arranged in a matrix as shown in FIGS. 5 and 6. In other words, the actuator unit 21 has a size enabling the unit 21 to straddle all of the pressure chambers 10 and dummy chambers 60. The FPC 50 has, in its proximal end portion, a connected portion 50*a* at which the FPC 50 is connected to a connector of the controller (not shown) provided in the inkjet printer. In the connected portion 50*a*, there are arranged a multiplicity of connector terminals 83 (see FIG. 9).

<Construction of Ink-Passage Defining Unit>

FIG. 5 is an enlarged view of a region A which is surrounded by one-dot chain line in FIG. 4. The ink-passage defining unit 4 defines the pressure chambers 10 and the dummy chambers 60 such that the pressure chambers 10 are arranged in a total of sixteen rows 11 which extend in parallel to the manifold passages 5 while the dummy chambers 60 are arranged in a total of four rows 61 which extend in parallel to the rows 11 of the pressure chambers 10. The sixteen rows 11 are separated into two groups, by the four rows 61 which are located between the two groups of the rows 11. One of the two groups consists of twelve rows 11, while the other of the two groups consists of four rows 11. As is apparent from FIG. 5, the pressure chambers 10 and the dummy chambers 60 are identical with each other in size and in shape in the plan view. In the ink-passage defining unit 4, the multiplicity of pressure chambers 10 and dummy chambers 60 are regularly arranged according to a predetermined pattern, where the pressure chambers 10 and the dummy chambers 60 are not particularly distinguished from each other. In other words, the pressure chambers 10 and the dummy chambers 60 cooperate with each other to form a predetermined arrangement pattern.

Each of the pressure chambers 10 formed in the ink-passage defining unit 4 has, in the plan view, a diamond-like shape having rounded corners. A longer one of diagonal lines of the diamond-like shape is parallel to the primary scanning direction (i.e., width direction of the ink-passage defining unit 4). Each pressure chamber 10 is held in communication at one of its longitudinal end portions with the corresponding nozzle 8, and is held in communication at the other longitudinal end portion with the corresponding manifold passage 5 via a corresponding one of apertures 13 (see FIG. 6), so that each manifold passage 5 is held in communication with a corresponding one of vertically extending passages 7 which communicate the respective pressure chambers 10 and the respective nozzles 8. It is noted that the pressure chambers 10, apertures 18 and nozzles 8 formed in the ink-passage defining unit 4 are represented by solid lines in FIG. 5, instead of being represented by broken lines, for easier reading of the drawing.

As shown in FIG. 6, which is a cross sectional view taken along line 6-6 of FIG. 5, each nozzle 8 is held in communication with the corresponding manifold passage 5 via the corresponding pressure chamber 10 and aperture (restricted passage) 13. That is, in the main body 70 of the inkjet head 1, there are formed individual channels each of which is constituted by the corresponding aperture 13 (connected to an exit of the corresponding manifold passage 5), pressure chamber 10, vertically extending passage 7 and nozzle 8.

The main body 70 of the inkjet head 1 is a laminar structure consisting of a total of ten sheets or plates superposed on each other. The ten plates consist of the actuator unit 21, cavity plate 22, base plate 23, aperture plate 24, supply plate 25, manifold plates 26-29 and nozzle plate 30, which are arranged in the order of description. Among the ten plates, nine plates other than the actuator unit 21 cooperate with each other to constitute the ink-passage defining unit 4.

The actuator unit 21 is a laminated body consisting of four piezoelectric sheets 31-34 (see FIG. 7) which are superposed on each other. Among the four piezoelectric sheets 31-34, the uppermost sheet 31 is an active layer including portions which serve as active portions upon generation of electric field thereacross, while the other sheets 32-34 are inactive layers including no active portion. The cavity plate 22 is a metallic plate having a multiplicity of diamond-like shaped holes are formed therein. That is, the holes are formed in a portion of the metallic plate, to which portion the actuator unit 21 is bonded, so that the formed holes constitute the pressure chambers 10 and dummy chambers 60. The base plate 23 is a metallic plate having communication holes formed therein. Some of the communication holes of the base plate 23 communicate the pressure chambers 10 and the apertures 13, while the other communication holes of the base plate 23 communicate the pressure chambers 10 and the nozzles 8.

The aperture plate 24 is a metallic plate having holes serving as the apertures 13 and communication holes communicating the pressure chambers 10 and the nozzles 8. The supply plate 25 is a metallic plate having communication holes communicating the manifold passages 5 and the apertures 13 and communication holes communicating the pressure chambers 10 and the nozzles 8. Each of the manifold passages 26-29 is a metallic plate having apertures each serving as a part of the corresponding manifold passage 5 and communication holes communicating the pressure chambers 10 and the nozzles 8. The nozzle plate 30 is a metallic plate having holes serving as the nozzles 8 which are held in communication with the pressure chambers 10.

The above-described ten sheets 21-30 are superposed on each other, while being positioned relative to each other such that the individual channels are established as shown in FIG. 6. Each of the individual channels extends upwardly from the corresponding manifold passage 5, extends horizontally in the corresponding aperture 13, extends further upwardly from the corresponding aperture 13 to the corresponding pressure chamber 10, extends horizontally in the corresponding pressure chamber 10, extends from the corresponding pressure chamber 10 in a diagonal downward direction away from the corresponding aperture 13 by a predetermined distance, and then extends to the corresponding nozzle 8 in a downward direction perpendicular to the direction in which the sheets 21-30 are superposed.

Referring back to FIG. 5, each pressure chamber 10 is held in communication at one of its longitudinal end portions (i.e., at one of its end portions which are opposite as viewed in a direction of the longer diagonal line) with the corresponding nozzle 8, and is held in communication at the other longitudinal end portion with the corresponding manifold passage 5 via the corresponding apertures 13. On the upper surface of the actuator unit 21, a multiplicity of individual electrodes 35 are provided to be arranged in a matrix. The individual electrodes 35, each having a diamond-like shape in the plan view and a size smaller than the corresponding pressure chamber 10, are located in respective positions which are opposed to the respective pressure chambers 10 (see FIGS. 7A and 7B). It is noted that only a few of the individual electrodes 35 are illustrated in FIG. 5, in the interest of simplifying the drawing.

The pressure chambers 10 and the dummy chambers 60 are provided by the holes which are formed in the cavity plate 22 and which are the same in shape and size. The holes providing the dummy chambers 60 are different from the holes providing the pressure chambers 10 in that each of them is closed at its opposite ends by the actuator unit 21 and the base plate 23. Thus, the dummy chambers 60 are isolated from the individual channels, so as not to be filled with the inks. The dummy chambers 60 are located to be adjacent to each other, and are arranged in a matrix establishing a zigzag pattern as viewed in a direction A (i.e., the secondary scanning direction) and also in a direction B, as shown in FIG. 5. The thus arranged dummy chambers 60 cooperate with each other to form four rows 61 which are parallel to each other. The dummy chambers 60 arranged in the four rows 61 constitute a dummy chamber group 62. The pressure chambers 10, which are as well as the dummy chambers 60 formed in the ink-passage defining unit 4, are located on opposite sides of the dummy chamber group 62, and constitute a plurality of pressure chamber groups 12 positioned to be asymmetric with respect to an imaginary line 15 which extends in a longitudinal direction of the nozzle defining surface 70*a* and which passes a center the nozzle defining surface 70*a* as viewed in a width direction of the nozzle defining surface 70*a*.

In the present embodiment, the pressure chambers 10 and the dummy chambers 60 are the same in shape and size, and disposed in the same manner. As a whole, the chambers 10, 60 are located to be adjacent to each other, and are arranged in a matrix establishing a zigzag pattern as viewed in the direction A and also in the direction B. It is noted that the direction A corresponds to the longitudinal direction of the inkjet head 1, namely, corresponds to the direction in which the ink-passage defining unit 4 is elongated, and is parallel to a direction of a shorter diagonal line of each of the diamond-like shaped pressure chambers 10. Meanwhile, the direction B corresponds to a direction of an oblique side of each of the diamond-like shaped pressure chambers 10, which side cooperates with the direction A to define an obtuse angle θ.

The pressure chambers 10, which are arranged in the zigzag pattern as viewed in two directions (i.e., directions A and B), are spaced apart from each other by a pitch as measured in the direction A, which pitch corresponds to an image resolution. In the present embodiment, for enabling the inkjet head 1 to perform a printing operation with an image resolution of 150 dpi (dots per inch), the pitch between each adjacent pair of the pressure chambers 10 as measured in the direction A is a distance corresponds to 37.5 dpi. The number of the pressure chambers 10, which are arranged in the zigzag pattern, is eight as counted along each line extending in a fourth (4th) direction orthogonal to the direction A, as seen in a third (3rd) direction perpendicular to the surface of the drawing sheet of FIG. 5. The number of the dummy chambers 60, which are also arranged in the zigzag pattern, is two as counted along each line extending in the fourth direction, as seen in the third direction. The number of the pressure chambers 10 and the number of the dummy chambers 60 are sixteen and four, respectively, as counted in the direction B.

The multiplicity of pressure chambers 10 arranged in the matrix cooperate to form a total of sixteen rows 11 each extending in the direction A. The sixteen rows 11 are categorized into four families, depending upon their positions relative to the corresponding manifold passage 5 as seen in the third direction. The four families are first family 11*a*, second family 11*b*, third family 11*e* and fourth family 11*d*. The rows 11 of the first through fourth families 11*a*-11*d* are cyclically arranged in an order of 11*c*-11*a*-11*d*-11*b*-11*c*-11*a*- . . . -11*b*, as viewed in a direction away from one of ends of the ink-passage defining unit 4 which are opposite to each other in the width direction of the unit 4 (in the primary scanning direction), toward the other end, namely, as viewed in an upward direction in FIG. 5, such that each four families 11*c*, 11*a*, 11*d*, 11*b* cooperate to form a corresponding one of the four pressure chamber groups 12. The nozzles 8 held in communication with the respective pressure chambers 10 are positioned relative to each other, such that the nozzles 8 communicated with the respective pressure chambers 10 belonging to the same group 12 do not overlap as seen in the fourth direction, and such that the nozzles 8 communicated with the respective pressure chambers 10 belonging to the same family 11 and the different groups 12 overlap as seen in the fourth direction.

The pressure chambers 10 belonging to the same group 12 are held in communication with the same manifold passage 5 via the respective apertures 18. That is, the pressure chambers 10 are grouped into the four pressure chamber groups 12, depending upon which one of the manifold passages 5 each pressure chamber 10 is held in communication with. Thus, the four pressure chamber groups 12 correspond to the respective four color inks, and are accordingly referred to as the groups 12M, 12Y, 12C, 12K. Since the manifold passage 5K to which the black ink is to be supplied is located to be distant from the other manifold passages 5M, 5Y, 5C, as described above, the pressure chamber group 12K to which the black ink is to be supplied is located to be distant from the other groups 12M, 12Y, 12C. In this arrangement, each of the four color inks can be ejected through the nozzles 8 which are held in communication with the pressure chambers 10 of the corresponding group 12, upon change in volume of the pressure chambers 10 of the corresponding group 12 which is caused by activation of the actuator unit 21.

The ink-passage defining unit 4 is conceptually divided by the above-described imaginary line 15, into two regions, i.e., an upper region 17 and a lower region 18 which is located on a lower side of the upper region 17 as seen in FIG. 5. Among the four pressure chamber groups 12M, 12Y, 12C, 12K, two groups 12M, 12Y are located in the upper region 17 while the other two groups 12C, 12K are located in the lower region 18. That is, the same number of pressure chamber groups 12 are present in the upper and lower regions 17, 18.

Each of the pressure chambers 10*a*, 10*c* of the first and third families 11*a*, 11*c* is held in communication at an upper one of its longitudinal end portions with a corresponding one of the nozzles 8 which is located an upper right side of the each of the pressure chambers 10*a*, 10*c*, as seen in the third direction perpendicular to the surface of the drawing sheet of FIG. 5. Meanwhile, each of the pressure chambers 10*b*, 10*d* of the second and fourth families 11*b*, 11*d* is held in communication at a lower one of its longitudinal end portions with a corresponding one of the nozzles 8 which is located a lower left side of the each of the pressure chambers 10*b*, 10*d*, as seen in the third direction.

Further, each of the pressure chambers 10*a*, 10*d* of the first and fourth families 11*a*, 11*d* overlaps, in its portion corresponding to more than a half of its entirety, with a corresponding one of the manifold passages 5 as seen in the third direction. Meanwhile, each of the pressure chambers 10*b*, 10*c* of the second and third families 11*b*, 11*c* does not overlap substantially in its entirety with the manifold passages 5 as seen in the third direction. In this arrangement, each of the manifold passages 5 can be given a width increased as much as possible, without the nozzles 8 being made to overlap with the manifold passages 5, so that the inks can be smoothly supplied into the pressure chambers 10.

The nozzles 8, which open in the ink ejection portion of the nozzle defining surface 70*a* of the ink-passage defining unit 4, are located in respective positions which are not opposed to the dummy chambers 62. Therefore, the ink ejection portion of the nozzle defining surface 70*a* can be separated into a black region through which the black ink is to be ejected, and a chromatic color region through the magenta, yellow and cyan inks are to be ejected.

Since the ink ejection portion of the nozzle defining surface 70*a* is separated into the black region and the chromatic color region which are located on opposite sides of the dummy chamber group 62, the nozzles 8 for ejecting the black ink are separated from the nozzles 8 for ejecting the chromatic color inks. Owing to this arrangement, it is possible to restrain the black ink from being mixed into the chromatic color inks, for example, in a maintenance operation in which the nozzle defining surface 70*a* is wiped with a blade (not shown) made of an elastic plate so as to remove the inks sticking to the nozzle defining surface 70*a*. If the black region and the chromatic color region were contiguous or close to each other, the black ink would be carried by the blade to the chromatic color region, possibly remaining in vicinity of an exit of each of the nozzles 8 through which the chromatic color inks are to be ejected, and accordingly causing undesirable mixture of the black ink with the chromatic color inks. However, in the present embodiment, the black region and the chromatic color region are located on the opposite sides of the dummy chamber group 62, so as to be distant from each other, so that the black ink is unlikely to reach the chromatic color region even if the black ink were carried by the blade in the maintenance operation, thereby eliminating a risk of mixing of the black ink into the chromatic color inks.

<Construction of Actuator Unit>

Figure 7A:
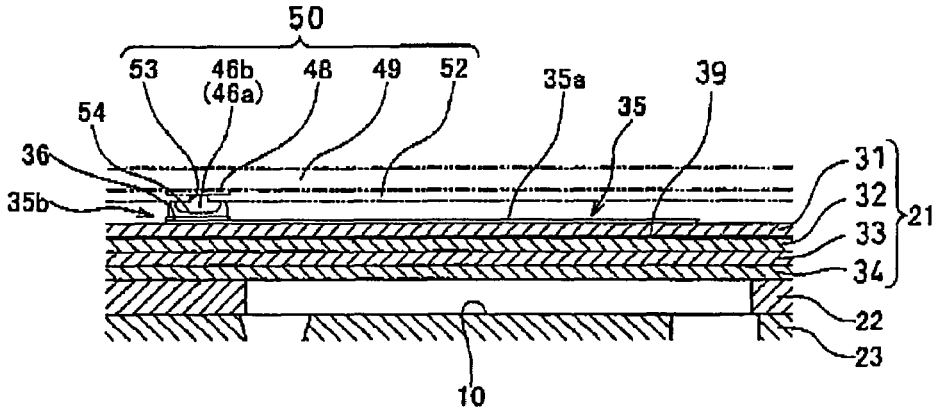
FIG. 7A is an enlarged view of a portion of an actuator unit of the inkjet head of FIG. 1, which portion is surrounded by one-dot chain line in FIG. 6.
Figure 7B:
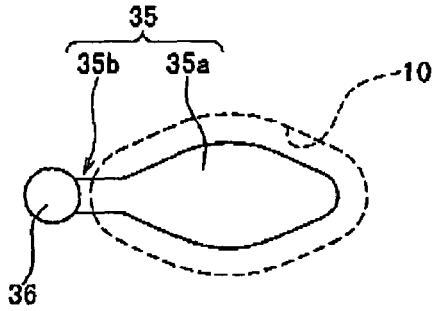
FIG. 7B is a plan view of an individual electrode of the actuator unit.
Figure 8:
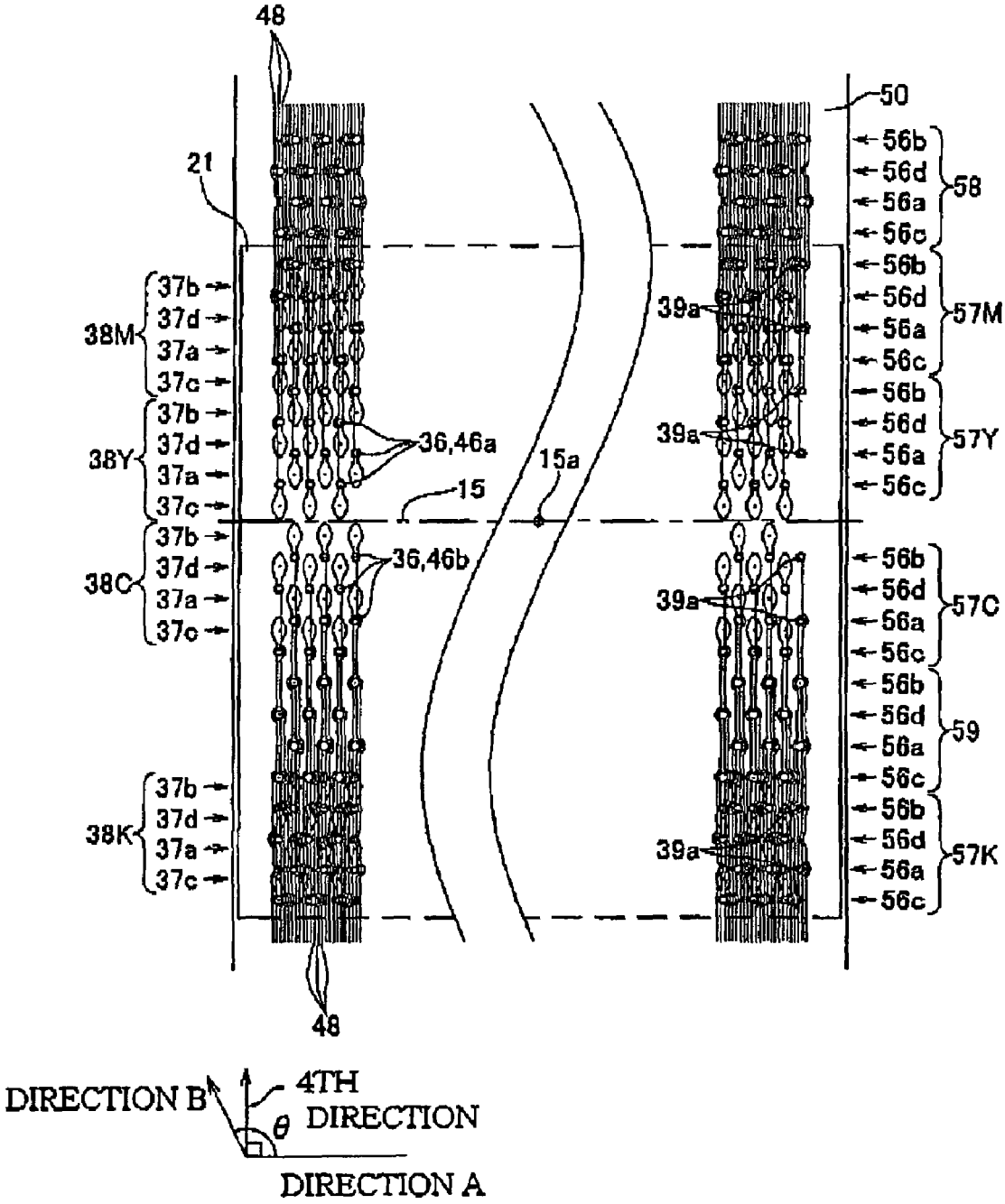
FIG. 8 is an enlarged view of a portion which is surrounded by two-dot chain line in FIG. 4.

Referring next to FIGS. 7 and 8, there will be described a construction of the actuator unit 21 in detail. On the upper surface of the actuator unit 21, the multiplicity of individual electrodes 35 are arranged in a matrix, namely, according to the same pattern as the above-described arrangement of the pressure chambers 10. Each of the individual electrodes 35 is located in a position opposed to a corresponding one of the pressure chambers 10 in the plan view. The arrangement of the pressure chambers 10 and the individual electrodes 35 according to the predetermined pattern facilitates design of the inkjet head 1.

FIG. 7A is an enlarged view of a portion of the actuator unit 21, which portion is surrounded by one-dot chain line in FIG. 6. FIG. 7B is a plan view of one of the individual electrodes 35. FIG. 8 is an enlarged view of a portion B which is surrounded by two-dot chain line in FIG. 4. The FPC 50, which is electrically connected to the individual electrodes 35, is represented by two-dot chain line in FIG. 7A. The terminals 46 and drive wires 48 of the FPC 60 are represented by solid lines in FIG. 8, instead of being represented by broken lines, for easier reading of the drawing. Further, some of the individual electrodes 35 of the actuator unit 21 are represented by solid lines in FIG. 8. As shown in FIGS. 7A and 7B, the individual electrodes 35 are located in respective positions opposed to the respective pressure chambers 10. Each of the individual electrodes 35 is constituted by a main portion 35*a* and an auxiliary portion 35*b* which are contiguous to each other. The main portion 35*a* is located within the corresponding pressure chamber 10 in the plan view, while the auxiliary portion 35*b* is deviated from the corresponding pressure chamber 10 in the plan view.

The actuator unit 21 includes the four piezoelectric sheets 31, 32, 33, 34 having substantially the same thickness of about 15 μm, as shown in FIG. 7A. Each of the sheets 31-34 is provided by a continuous flat layer or plate which is arranged to straddle the multiplicity of pressure chambers 10 which are formed in the ink ejection portion of the nozzle defining surface 70*a* of the ink-passage defining unit 4. Since each of the sheets 31-34 is thus arranged to cover the multiplicity of pressure chambers 10, the individual electrodes 35 can be formed on the piezoelectric sheet 31 with a high density by using a screen printing technique. Therefore, the pressure chambers 10, which are to be located in respective positions corresponding to the respective individual electrodes 35, can be formed also with a high density, thereby enabling the inkjet head 1 to perform a printing operation with high resolution. It is noted that the piezoelectric sheets 31-34 are made of PZT (lead zirconate titanate) based ceramic material having a ferroelectricity.

The main portion 35*a* of each individual electrode 35 formed on the uppermost piezoelectric sheet 31 has a diamond-like shape almost similar to the shape of the pressure chamber 10, as shown in FIG. 7B. The main portion 35*a* includes an acute end portion which extends up to the auxiliary portion 35*b*. At an end of the auxiliary portion 35*b*, there is formed a circular land 36 which is electrically connected to the corresponding individual electrode 35. As shown in FIG. 7B, the land 36 is located in a position under which the pressure chamber 10 is not present in the cavity plate 11. The land 36 is made of gold containing glass frit, for example, and is provided on a surface of the auxiliary portion 35*b*, as shown in FIG. 7A.

The multiplicity of individual electrodes 35 arranged in a plurality of rows 37 which extend in the direction A as the rows 11 of the pressure chambers 10 formed in the cavity plate 22. The rows 37, extending in parallel to each other, are categorized into four families 37*a*-37*d* corresponding to the respective families 11*a*-11*d* of the pressure chambers 10. Each four families 37*a*-37*d* cooperate to form a corresponding one of four individual electrode groups 38M, 38Y, 38C, 38K which correspond to the respective four pressure chamber groups 12M, 12Y, 12C, 12K. In the present embodiment, each of the four individual electrode groups 38 consists of the families 37*a*-37*d*, wherein the number of the individual electrodes 35 constituting each of the families 37*a*, 37*b* is smaller by one, than the number of the individual electrodes 35 constituting each of the families 37*c*, 37*d*. The rows 37 of the larger families 37*c*, 37*d* and the rows of the smaller families 37*a*, 37*b* are alternately arranged as viewed in the fourth direction (in the primary scanning direction corresponding to the width direction of the actuator unit 21). That is, as shown in FIG. 8, the rows 37 of the first through fourth families 37*a*-37*d* are cyclically arranged in an order of 37*c*-37*a*-37*d*-37*b*-37*c*-37*a*- . . . -37*b*, as viewed in a direction away from one of ends of the actuator unit 21 which are opposite to each other in the width direction of the unit 21 (in the primary scanning direction), toward the other end, namely, as viewed in an upward direction in FIG. 8, such that each adjacent four families 37*c*, 37*a*, 37*d*, 37*b* cooperate to form a corresponding one of the four individual electrode groups 38.

The individual electrode groups 38M, 38Y are located in respective positions opposed to the pressure chamber groups 12M, 12Y, while the individual electrode groups 38C, 38K are located in respective positions opposed to the pressure chamber groups 12C, 12K, The auxiliary portions 35*b* of the individual electrodes 35 of the groups 38M, 38Y which are located on an upper side of the imaginary line 15 are formed to face upwardly as seen in FIG. 8. Meanwhile, the auxiliary portions 35*b* of the individual electrodes 35 of the groups 38C, 38K which are located on a lower side of the imaginary line 15 are formed to face downwardly as seen in FIG. 8. In other words, each of the auxiliary portions 35*b* of the individual electrodes 35 faces towards a corresponding one of the first and second driver ICs 75*a*, 75*b* to which the each of the auxiliary portions 35*b* is connected through the corresponding land 36 and the FPC 50.

Between the uppermost piezoelectric sheet 31 and the second uppermost piezoelectric sheet 32, there is interposed a common electrode 39 which has the same contour as the piezoelectric sheet 31 and a thickness of about 2 μm, as shown in FIG. 7A. The common electrode 39 as well as the individual electrodes 35 is formed of Ag—Pd based metallic material, for example.

The common electrode 39 is connected to a plurality of common lands 39*a* which are as well as the individual electrodes 35 formed on the upper surface of the piezoelectric sheet 31. The common electrodes 39*a* are located in a right side portion, as seen in FIG. 8, of the piezoelectric sheet 31, and are arranged in the fourth direction. The piezoelectric sheet 31 has a plurality of through-holes (not shown) formed there through in its thickness direction. The through-holes are located in respective positions in which the common lands 39*a* are formed, and accommodate therein respective conductive bodies, so that the common electrode 39 is electrically connected to the common lands 39*a* via the conductive bodies. Each of the common lands 39*a* is contiguous to the lands 36, which are connected to the individual electrodes 35 of the rows 37 of the smaller families 37*a*, 37*b*, as viewed in the direction A. That is, each of the common lands 39*a* is spaced apart from a rightmost one, as seen in FIG. 8, of the lands 36 by a distance corresponding to a spacing distance between each adjacent pair of the lands 36. Thus, each of the common lands 39*a* is located in a position lying on an extension of a row of the lands 36 which are connected to the individual electrodes 35 of the rows 37 of the smaller families 37*a*, 37*b*. Where it is considered that each of the common lands 39*a* cooperates with the lands 86 to constitute the land row, all the land rows are the same with respect to the number of the lands constituting the row. Thus, the individual electrodes 35 and the lands 36 constituting the individual electrode rows 37 and the land rows can be arranged regularly. It is noted that the common lands 39*a* are connected to terminals 46*a*, 46*b* which are formed on the FPC 50. The common electrode 39 is held in a constant potential evenly over its region covering all the pressure chambers 10. In the present embodiment, the common electrode 39 is grounded.

<Construction of FPC>

The FPC 50 includes: a base film 49; a plurality of drive wires 48 formed on a lower surface of the base film 49; a plurality of controller wires 81; and a cover film 52 covering substantially an entirety of a lower surface of the base film 49, as shown in FIG. 7A. The base film 49, drive wire 48 and cover film 62 have respective thickness values of about 25 μm, about 9 μm and about 20 μm, respectively. The cover film 52 has a plurality of through-holes 53 each having a cross sectional area smaller than that of each drive wire 48. Each of the through-holes 53 is located a position aligned with a corresponding one of the lands 36 and common lands 39*a* which are formed on the actuator unit 21. The base film 49, drive wires 48 and cover film 52 are superposed on each other such that a center of each of the through-holes 53 is aligned with a center line of a corresponding one of the drive wires 48. Thus, in portions in which the through-holes 63 are formed, each drive wire 48 is covered at its peripheral portion by the cover film 52. Further, the output terminals 46*a*, 46*b* of the FPC 50 are formed to be connected to the respective drive wires 48 and to extend through the respective through-holes 53.

Each of the base film 49 and cover film 52 is provided by an insulating sheet. In the present embodiment, the base film 49 is made of polyimide resin, while the cover film 52 is made of photosensitive material. Since the cover film 52 is constituted by the photosensitive material, the multiplicity of through-holes 53 can be easily formed through the cover film 52.

The drive wires 48 and controller wires 81 are provided by copper foil wiring patterns which are formed on a lower surface of the base film 49 (see FIG. 9) The drive wires 48 are wires connected to the first and second driver ICs 75*a*, 75*b*, while the controller wires 81 are wires connected to the connector terminals 83 which are disposed on the proximal end portion of the FPC 50.

The terminals 46*a*, 46*b* are made of a conductive material such as nickel, and are arranged to project downwardly from the lower surface of the cover film 52. The through-holes 53 (formed through the cover film 52) are filled with the terminals 46*a*, 46*b*, and portions of the lower surface of the cover film 62 surrounding the through-holes 53 are covered by the terminals 46*a*, 46*b*. Each of the terminals 46*a*, 46*b* has a diameter of about 50 μm, and a thickness of about 30 μm as measured from the lower surface of the cover film 52.

<Fixing of FPC to Actuator Unit>

As shown in FIG. 8, some of the terminals 46*a*, 46*b* of the FPC 50 are opposed to the lands 36 or common lands 39*a*, while the other of the terminals 46*a*, 46*b* are not opposed to them. In this arrangement, each of only those of the terminals 46*a*, 46*b* opposed to the lands 36 or common lands 39*a* is electrically connected to the opposed land 36 or common land 39*a* through a solder 54. FIG. 7A shows one of the lands 36 connected to terminals 46. From each of the terminals 46*a* of the FPC 50, the drive wire (first drive wire) 48 extends in the fourth direction toward the first driver IC 75*a*. From each of the terminals 46*b* of the FPC 50, the drive wire (second drive wire) 48 extends in the fourth direction toward the second driver IC 75*b*. Therefore, the first drive wires 48 extending toward the first driver IC 75*a* are not opposed or adjacent to the second drive wires 48 extending toward the second driver IC 75*b*.

The plurality of terminals 46*a*, 46*b* of the FPC 50 cooperate to form a total of twenty-four terminal rows 56 each extending in the direction A. The twenty-four terminal rows 56 are grouped into sixteen terminal rows 56 constituted by the terminals 46*a*, 46*b* which are opposed to the lands 36 or common lands 39*a*, and eight terminal rows 56 constituted by the terminals 46*a*, 46*b* which are not opposed to the lands 36 or common lands 39*a*. The sixteenth terminal rows 56 consist of four terminal groups 57M, 57Y, 57C, 57K which correspond to the respective individual electrode groups 38M, 38Y, 38C, 38K. Each of the four terminal groups 57M, 57Y, 57C, 57K (corresponding to nozzle groups) consists of four terminal rows 56*a*, 56*b*, 56*c*, 56*d*, which are opposed to the individual electrode rows 37*a*, 37*b*, 37*c*, 37*d*, respectively. Meanwhile, the eight terminal rows 56 consist of two terminal groups 58, 59. In FIG. 8, four terminal rows 56 belonging to each of the two terminal groups 58, 59 are denoted by reference signs 56*a*, 56*b*, 56*c*, 56*d* in the same order as the terminal rows 56 belonging the terminal groups 57M, 57Y.

As shown in FIG. 8, each of the terminals 46*a* of the terminal group 57M (which is a second group as counted from the imaginary line 15 in an upward direction toward the first driver IC 75*a*) is connected, through a corresponding one of the first drive wires 48, to one of the terminals 46*a* of the terminal group 58 which has the same relative position as the each of the terminals 46*a* of the terminal group 57M. Each of the terminals 46*b* of the terminal group 57K (which is a third group as counted from the imaginary line 15 in an downward direction toward the second driver IC 75*b*) is connected, through a corresponding one of the second drive wires 48, to one of the terminals 46*a* of the terminal group 59 which has the same relative position as the each of the terminals 46*b* of the terminal group 57K. Further, among the four terminal rows 56*a*, 56*b*, 56*c*, 56*d* of each of the terminal groups 57M, 57Y, 57C, 57K, a rightmost one, as seen in FIG. 8, of the terminals 46*a*, 46*b* of each of the terminal rows 56*a*, 56*b* is connected to the corresponding common land 39*a*. Thus, the common electrode 39 is grounded via the common lands 39*a*.

According to the arrangement as described above, the terminals 46*a* of the terminal group 58 are connected, through the terminals 46*a* of the terminal group 57M, to the respective lands (or common lands) 36, 39*a* of the individual electrode group 38M which corresponds to the pressure chamber group 12M. In other words, the terminals 46*a* of the terminal group 58 are connected indirectly to the respective lands (or common lands) 36, 39*a* through the respective first drive wires 48. Further, the terminals 46*b* of the terminal group 59 are connected, through the terminals 46*b* of the terminal group 57K, to the respective lands (or common lands) 36, 39*a* of the individual electrode group 38K which corresponds to the pressure chamber group 12K. In other words, the terminals 46*b* of the terminal group 59 are connected indirectly to the respective lands (or common lands) 36, 39*a* through the respective second drive wires 48.

The terminals 46*a*, 46*b* formed on the FPC 50 are arranged to be symmetrical with respect to a midpoint 15*a* of a segment of the imaginary line 15 which is located within the actuator unit 21 in the plan view as shown in FIG. 8. That is, if the FPC 50 is rotated by 180° about the midpoint 15*a* of the segment of the imaginary line 15, the terminals 46*a* is positioned in respective positions in which the terminals 46*b* used to be positioned before the rotation of the FPC 50. Therefore, depending upon a manner according to which the inkjet head 1 is to be controller by the controller, the FPC 50 can be attached to the actuator unit 21, with the FPC 50 being rotated by 180° about the midpoint 15*a* of the segment of the imaginary line 15.

<Connection of Actuator Unit and Driver ICs Via Wires in FPC>

Figure 9:
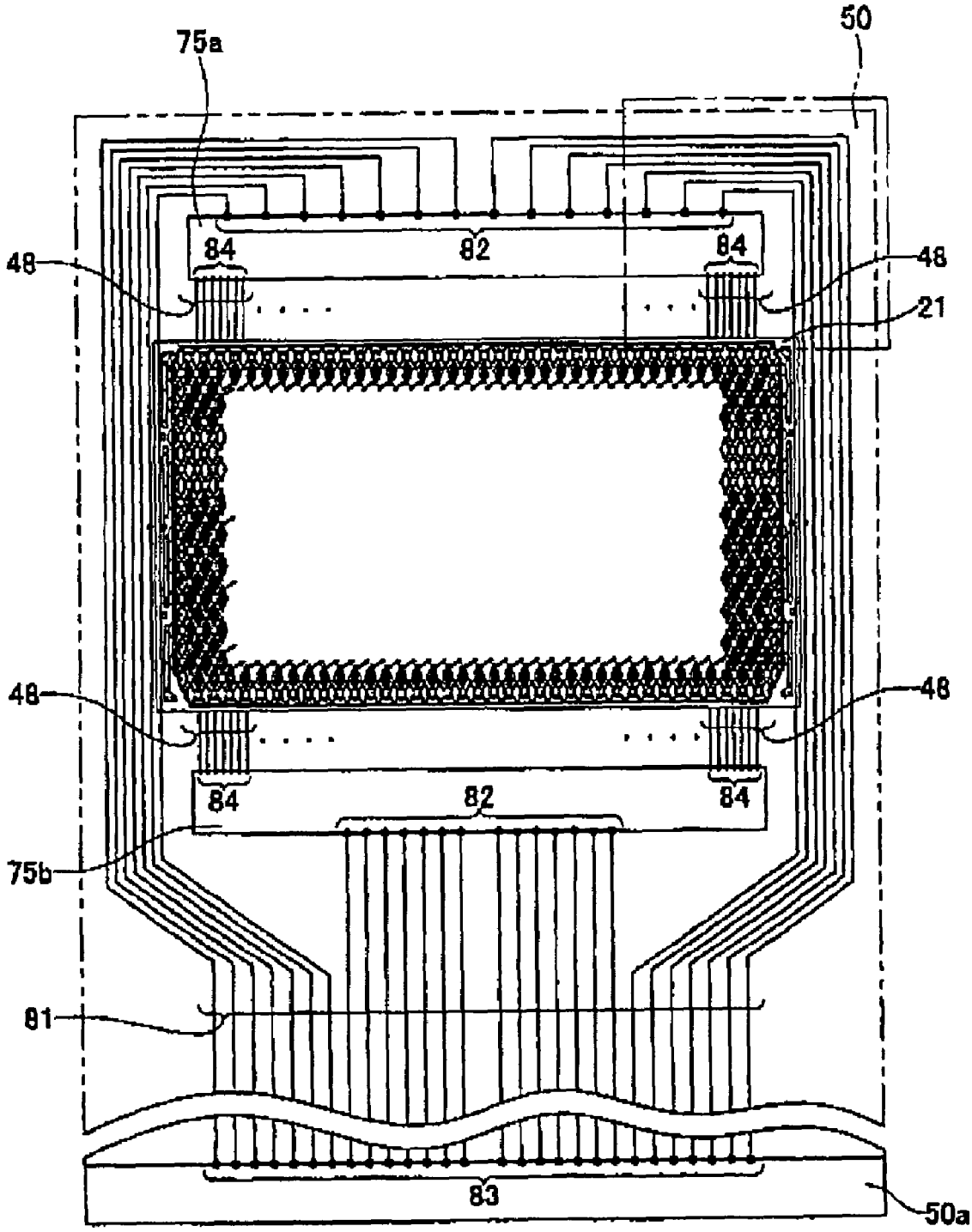
FIG. 9 is a view showing an arrangement of wires which are provided on a flexible printed circuit to connect the actuator unit and driver circuits in the inkjet head of FIG. 1.
Figure 10:
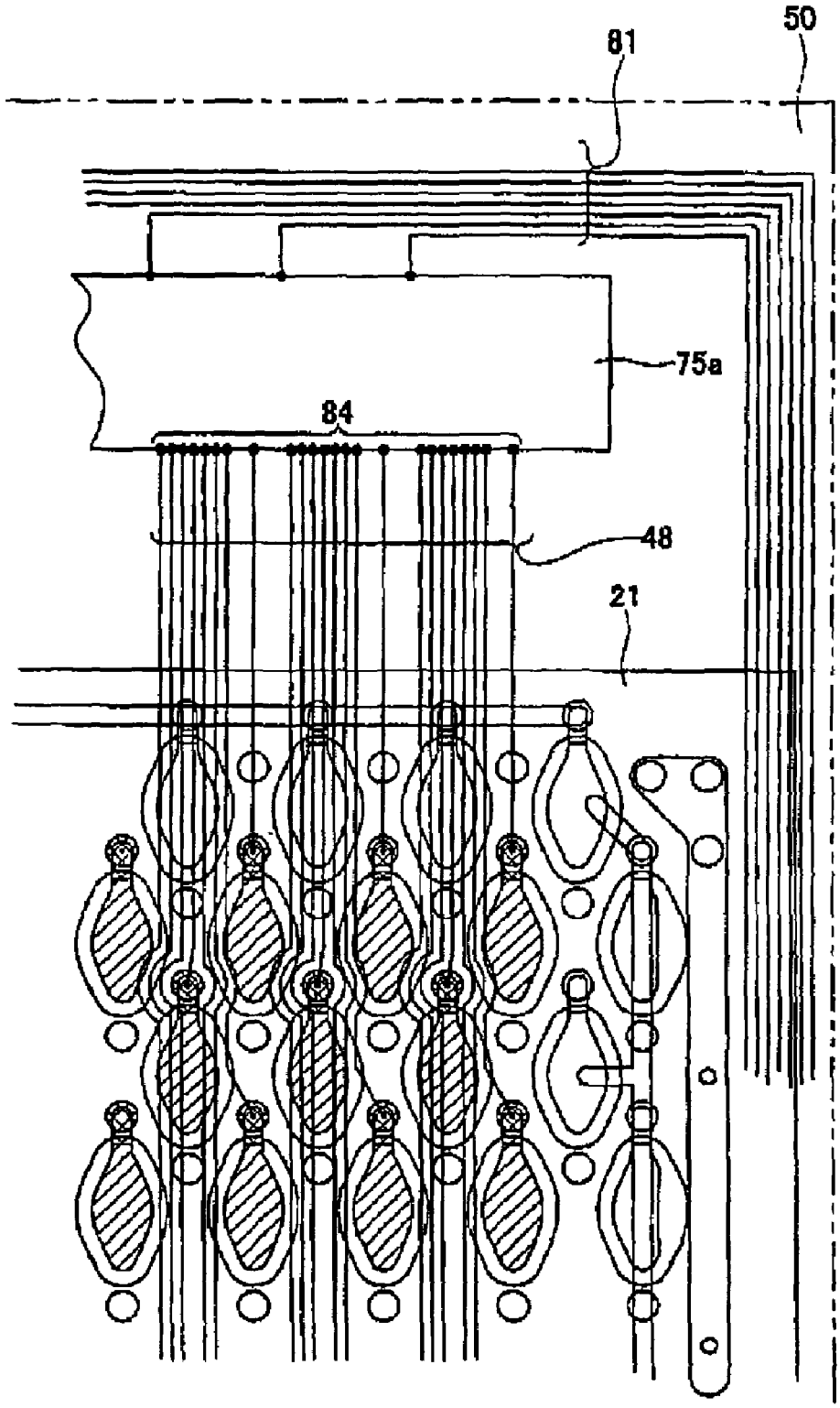
FIG. 10 is an enlarged view of a portion of the flexible printed circuit, which portion is surrounded by one-dot chain line in FIG. 9.

Referring next to FIGS. 9 and 10, there will be described a connection of the actuator unit 21 and the driver ICs 75*a*, 75*b* via wires in the FPC 50. FIG. 9 is a view showing a wiring arrangement provided on the FPC 60 to connect the actuator unit 21 and the driver ICs 76*a*, 76*b*. FIG. 10 is an enlarged view of a portion surrounded by one-dot chain line in FIG. 9. As shown in FIGS. 9 and 10, the connector terminals 83 are provided in the connected portion 50*a* which corresponds to a longitudinal end portion of the FPC 50, and are arranged in a row extending in a width direction of the FPC 50. The controller wires 81 are categorized into first controller wires 81 which electrically connect a plurality of control signal terminals 82 of the first driver IC 75*a* and the respective connector terminals 83 of the connected portion 50*a*, and second controller wires 81 which electrically connect a plurality of control signal terminals 82 of the second driver IC 75*b* and the respective connector terminals 83. The controller (not shown) is operable to supply control signals corresponding to image data, to the control signal terminals 82 of the first and second driver ICs 75*a*, 75*b* through the controller wires 81.

The drive wires 48, connecting drive signal terminals 84 of the driver ICs and the respective lands 36 of the actuator unit 21, is arranged to extend straight. The second controller wires 81, connecting the control signal terminal 82 of the second driver IC 75*b* and the respective connector terminals 83 of the connected portion 50*a*, is arranged to extend straight. The first controller wires 81, connecting the control signal terminals 82 of the first driver IC 75*a* and the respective connector terminals 83 of the connected portion 50*a*, is arranged to bypass or pass outside the first and second driver ICs 75*a*, 75*b* and then pass across a line which passes the second driver IC 75*b* and which is perpendicular to a line connecting the first and second driver ICs 75*a*, 75*b*, so as to connect the control signal terminals 82 and the respective connector terminals 83. In other words, each of the first controller wires 81 includes a portion bypassing the first and second driver ICs 75*a*, 75*b*, and does not include a portion overlapping with a terminal portion of the FPC 50 in which the terminal 46*a*, 46*b* are disposed, as viewed in the plan view. This arrangement avoids the first controller wires 81 (connected to the first driver IC 75*a*) from passing among the terminals 46*a*, 46*b*. Thus, the first controller wires 81 are arranged to surround or bypass a drive wiring portion of the FPC 50 in which the drive wires 48 are disposed, without the controller wires 81 overlapping with the drive wiring portion, as viewed in the plan view.

<Fixing of FPC to Passage Defining Unit>

Figure 11:
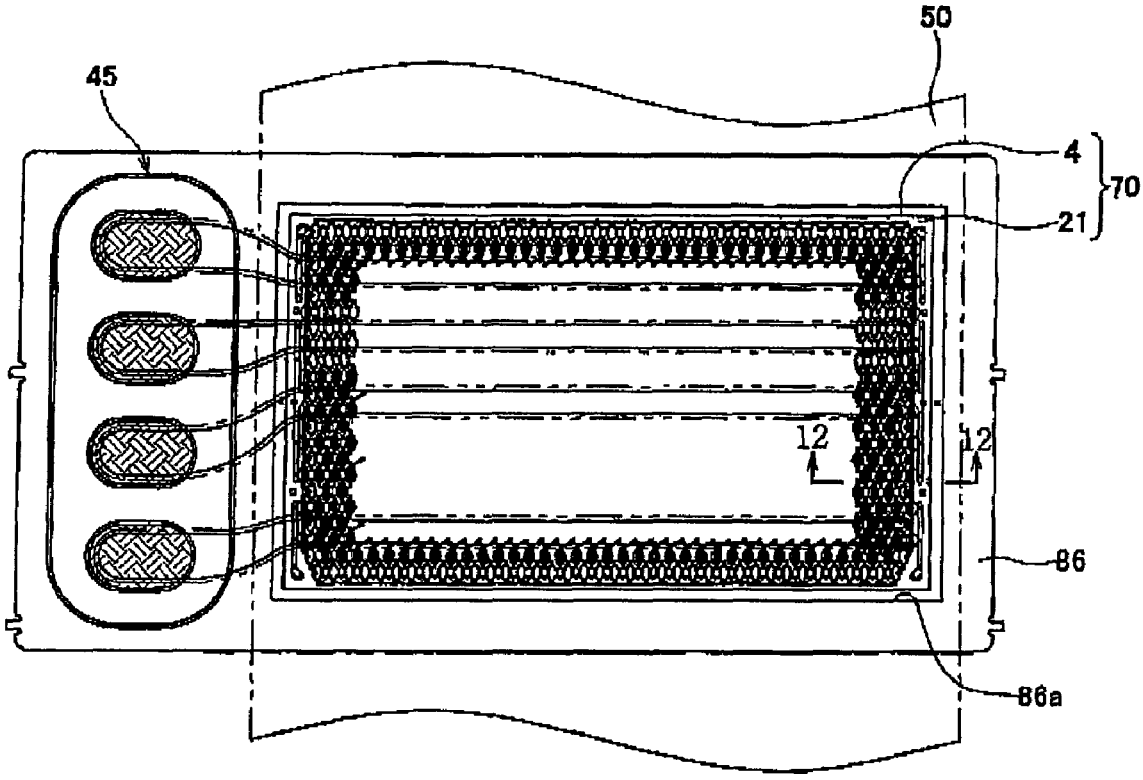
FIG. 11 is a view showing the flexible printed circuit which is fixed to the main body of the inkjet head of FIG. 1.
Figure 12:
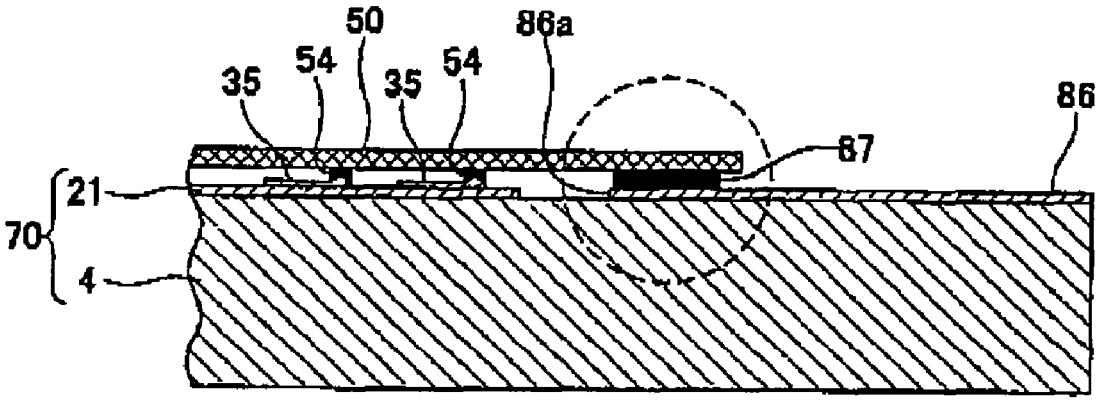
FIG. 12 is a cross sectional view taken along line 12-12 of FIG. 11.
Figure 13:
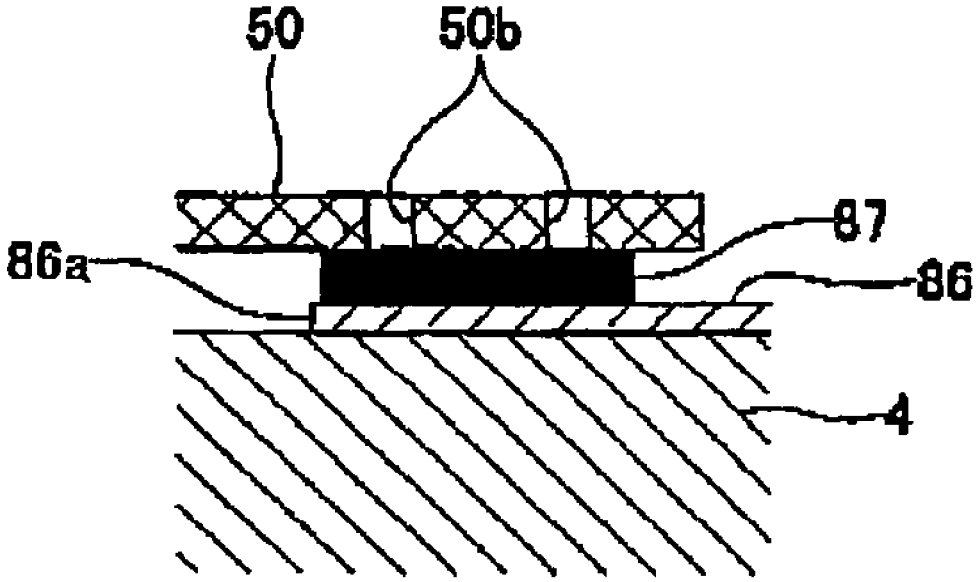
FIG. 13 is an enlarged view of a portion which is surrounded by broken line in FIG. 12.

Referring next to FIGS. 11-13, there will be described an arrangement for fixing the FPC 50 to the ink-passage defining unit 4. FIG. 11 is a view showing a state in which the FPC 50 is fixed to the ink-passage defining unit 4, wherein the reinforcement plate 41 is not illustrated for easier reading of the drawing. FIG. 12 is a cross sectional view taken along line 12-12 of FIG. 11. FIG. 13 is an enlarged view of a portion which is surrounded by broken line in FIG. 12. As shown in FIGS. 11 and 12, an attachment frame 86 is bonded to be held in close contact with the upper surface of the ink-passage defining unit 4 (to which the actuator unit 21 is fixed as described above). The attachment frame 86 is provided by a thin plate or sheet having a rectangular-shaped hole 86*a* formed there through, such that the actuator unit 21 is surrounded by the frame 86, namely, such that the actuator unit 21 is located within the rectangular-shaped hole 86*a* of the frame 86. The FPC 50 connected to the actuator unit 21 is arranged to cover the hole 86*a*. While the frame 86 has the same thickness as the actuator unit 21 in the present embodiment, the thickness of the frame 86 may be held in a range which is not smaller than the thickness of the actuator unit 21 and which is not larger than a sum of the thickness of the actuator unit 21 and 50 μm.

The FPC 50 is fixed to the frame 86 by an adhesive 87 applied to a portion of the frame 86 which surrounds the rectangular-shaped hole 86*a*. In other words, the FPC 50 is bonded to the upper surface of the ink-passage defining unit 4 through the attachment frame 86. Since the adhesive 87 is applied to completely surround an outer periphery of the hole 86*a*, the actuator unit 21 disposed within the hole 86*a* is sealed by the FPC 50, adhesive 87 and ink-passage defining unit 4. In the present embodiment, the opening 42 of the reinforcement plate 41 is one size larger than a bonded portion of the FPC 50 which portion is bonded to the attachment frame 86 by the adhesive 87 (see FIG. 3), so that the bonded portion of the FPC 50 is exposed through the opening 42 of the reinforcement plate 41.

As shown in FIG. 13, the FPC 60 has through-holes 50*b* located in its portion which is opposed to the above-described portion of the frame 86, so that excess of the adhesive 87 can be accommodated in the through-holes 50*b*, whereby the adhesive 87 can be efficiently applied onto the above-described portion of the frame 86. This arrangement prevents the excess of the adhesive 87 from reaching a surface of the actuator unit 21, whereby displacements of the active portions of the actuator unit 21 are not impeded by the excess of the adhesive 87.

<Arrangement for Driving Actuator Unit>

Next, there will be next described an arrangement for driving the actuator unit 21. In the present embodiment, the piezoelectric sheet 31 of the actuator unit 21 is arranged to be polarizable in its thickness direction. That is, the actuator unit 21 is of a so-called unimorph type in which the uppermost piezoelectric sheet 31 (which is most distant from the pressure chambers 10) serves as the active layer including the active portions while the other three piezoelectric sheets 32-34 (which are close to the pressure chambers 10) serve as the inactive layers. In this arrangement, when a predetermined positive or negative voltage is applied between a selected individual electrode or electrodes 35 and the common electrode 39 as an ground electrode such that directions of the electric field and the polarization coincide with each other, portion or portions of the piezoelectric sheet 31 interposed between the selected individual electrode or electrodes 35 and the common electrode 39 function as the active portions (pressure generator portions), so as to contract in a direction perpendicular to the polarization direction, owing to a transverse piezoelectric effect.

In the present embodiment, the portions of the piezoelectric sheet 31 interposed between the individual electrodes 35 and the common electrode 34 serve as the active portions, each of which generates a distortion owing to the piezoelectric effect upon application of an electric field between a corresponding one of the individual electrodes 35 and the common electrode 34 (see FIG. 7A). Meanwhile, each of the three piezoelectric sheets 32-34 underlying the piezoelectric sheet 31 is not polarizable, so as not substantially to serve as an active layer. Thus, the piezoelectric sheet 31 contracts mainly in its portions interposed between the main portions 35*a* of the respective individual electrodes 35 and the common electrode 39, in the direction perpendicular to the polarization direction, owing to the transverse piezoelectric effect.

Since the piezoelectric sheets 32-34 do not deform themselves, there is caused a difference between the uppermost piezoelectric sheet 31 and the other piezoelectric sheets 32-34, with respect to an amount of distortion or deformation in the direction perpendicular to the polarization direction, thereby causing a unimorph deformation, namely, causing the piezoelectric sheets 31-34 as a whole to be convexed downwardly, i.e., in a direction away from the uppermost piezoelectric sheet 31 as the active layer toward the other piezoelectric sheets 32-34 as the inactive layers. In this instance, since the actuator unit 21 is fixed at its lower surface to the cavity plate 22 serving as partition walls defining the pressure chambers 10 as shown in FIG. 7A, the piezoelectric sheets 31-34 are consequently deformed to be convexed toward the corresponding pressure chamber 10, thereby reducing the volume of the pressure chamber 10. The reduction in the volume of the pressure chamber 10 leads to increase in the pressure of the ink stored in the pressure chamber 10, causing the ink to be ejected through the corresponding nozzle 8. Thereafter, when the electric potential at the individual electrode 35 is returned to its original value which is the same as that of the common electrode 39, the sheets 31-34 restore their original shapes, so that the volume of the pressure chamber 10 is returned to its original value, whereby the ink is sucked from the corresponding manifold passage 5.

It is noted that the arrangement for driving the actuator unit 21 may be changed or modified as needed. For example, the potential at each individual electrode 35 may be normally set at a value different from the potential at the common electrode 39. In this modified arrangement, the potential at the corresponding individual electrode 35 is once equalized to the potential at the common electrode 39, in response to a signal requesting an ink ejection, and is then returned to the value different from the potential at the common electrode 39 at a predetermined point of time. That is, the piezoelectric sheets 31-34 restore their original shapes in response to the ink ejection requesting signal so that the volume of the pressure chamber 10 is increased to be larger than that in the initial state (in which the potential at each individual electrode 35 is set at the value different from the potential at the common electrode 39), whereby the ink is sucked to the pressure chamber 10 from the corresponding manifold passages 5. Then, at the predetermined point of time at which the potential at the individual electrode 85 is returned to the value different from the potential at the common electrode 39, the piezoelectric sheets 31-34 are deformed to be convexed toward the pressure chamber 10, whereby the ink is ejected as a result of increase in the pressure of the ink which is caused by reduction in the volume of the pressure chamber 10.

In the inkjet head 1 constructed as described above according to the first embodiment, the first drive wires 48 connected to the first driver IC 75*a* are not opposed to the second drive wires 48 connected to the second driver IC 75*b*, and the first controller wires 81 connected to the first driver IC 75*a* are not arranged to extend in a direction opposite to the second driver IC 75*b*. This wiring arrangement permits the area of the FPC 50 and the pitch between each adjacent pair of the wires to be reduced and increased, respectively, thereby making it possible to reduce a cost required to manufacture the FPC 50. Further, since the terminals 46*a*, 46*b* are located between the first and second driver ICs 75*a*, 75*b*, thermal influences of the first and second driver ICs 75*a*, 75*b* upon the actuator unit 21 and the ink-passage defining unit 4 can be substantially equalized.

Further, since each of the first controller wires 81 does not include a portion passing among the terminals 46*a*, 46*b*, the first controller wires 81 connected to the first driver IC 75*a* can be protected from noises generated by the drive wires 48.

Still further, since all the controller wires 81 are connected to the connector terminals 83 arranged in the connected portion 50*a*, the first and second driver ICs 75*a*, 75*b* can be efficiently connected to the controller through the connected portion 50*a*.

In addition, since the FPC 50 is fixedly bonded to the upper surface of the ink-passage defining unit 4 through the attachment frame 86 having a suitable thickness, it is possible to prevent the terminals 46*a*, 46*b* from being disconnected from the lands 36, even in presence of stress exerted on the FPC 50.

Moreover, a space within the hole 86*a* of the attachment frame 86 is enclosed or sealed by the FPC 50, adhesive 87 and ink-passage defining unit 4, while the actuator unit 21 is disposed in the space within the hole 86*a*. This sealing arrangement enables connections of the terminals 46*a*, 46*b* with the lands 36, to be protected from dusts.

<Modification>

Figure 14:
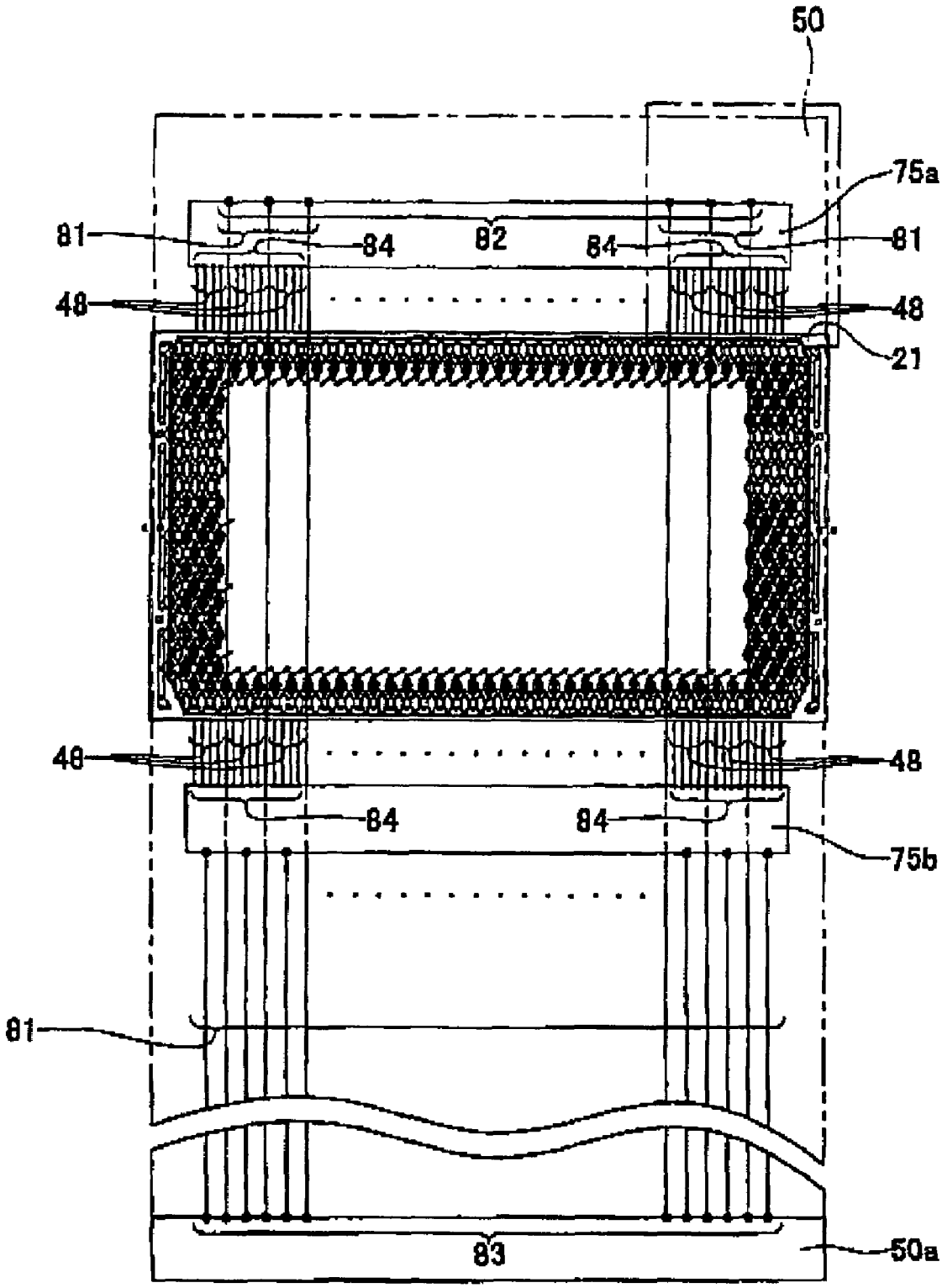
FIG. 14 is a view showing a modified arrangement of the wires which are provided on the flexible printed circuit to connect the actuator unit and the driver circuits in the inkjet head of FIG. 1.
Figure 15:
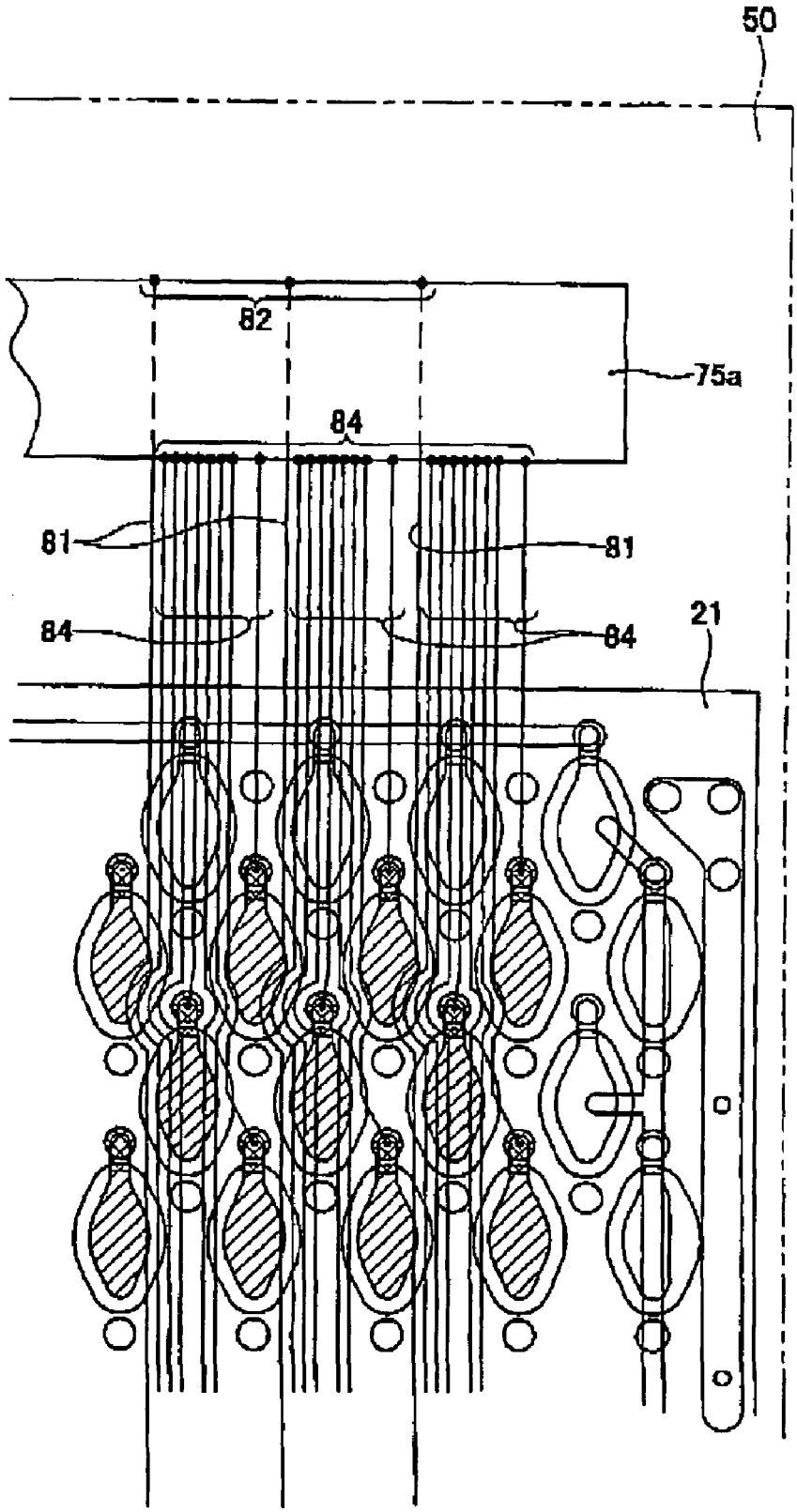
FIG. 15 is an enlarged view of a portion of the flexible printed circuit, which portion is surrounded by one-dot chain line in FIG. 14.

In the above-described first embodiment, the first controller wires 81 are arranged such that each of the first controller wires 81 does not include a portion which overlaps with the terminal portion of the FPC 50 (in which the terminal 46*a*, 46*b* are disposed) as viewed in a direction in which the ink-passage defining unit 4 and the actuator unit 21 are opposed to each other. However, this arrangement may be modified. FIG. 14 is a view showing a modified arrangement of the wires provided on the FPC 50 to connect the actuator unit 21 and the driver ICs 75*a*, 75*b*. FIG. 15 is an enlarged view of a portion surrounded by one-dot chain line in FIG. 14.

As shown in FIGS. 14 and 15, the connector terminals 83 are provided in the connected portion 50*a* which corresponds to a longitudinal end portion of the FPC 50, and are arranged in a row extending in a width direction of the FPC 50. The drive wires 48, connecting the drive signal terminals 84 of the driver ICs 75*a*, 75*b* and the respective lands 36 of the actuator unit 21, is arranged to extend straight. The second controller wires 81, connecting the control signal terminals 82 of the second driver IC 75*b* and the respective connector terminals 83 of the connected portion 50*a*, is arranged to extend straight. The first controller wires 81, connecting the control signal terminals 82 of the first driver IC 75*a* and the respective connector terminals 83 of the connected portion 50*a*, is arranged to pass below the first and second driver ICs 75*a*, 75*b* and then pass across a line which passes the second driver IC 75*b* and which is perpendicular to a line connecting the first and second driver ICs 75*a*, 75*b*, so as to connect the control signal terminals 82 and the respective connector terminals 83. In other words, each of the first controller wires 81 includes a portion passing among the terminals 46*a*, 46*b*, namely, a portion overlapping with a terminal portion of the FPC 50 in which the terminal 46*a*, 46*b* are disposed, as viewed in the plan view. In this modified arrangement, since the controller wires 81 are arranged to be opposed to the drive wires 48, the area of the FPC 50 can be further reduced.

Second Embodiment

Figure 16:
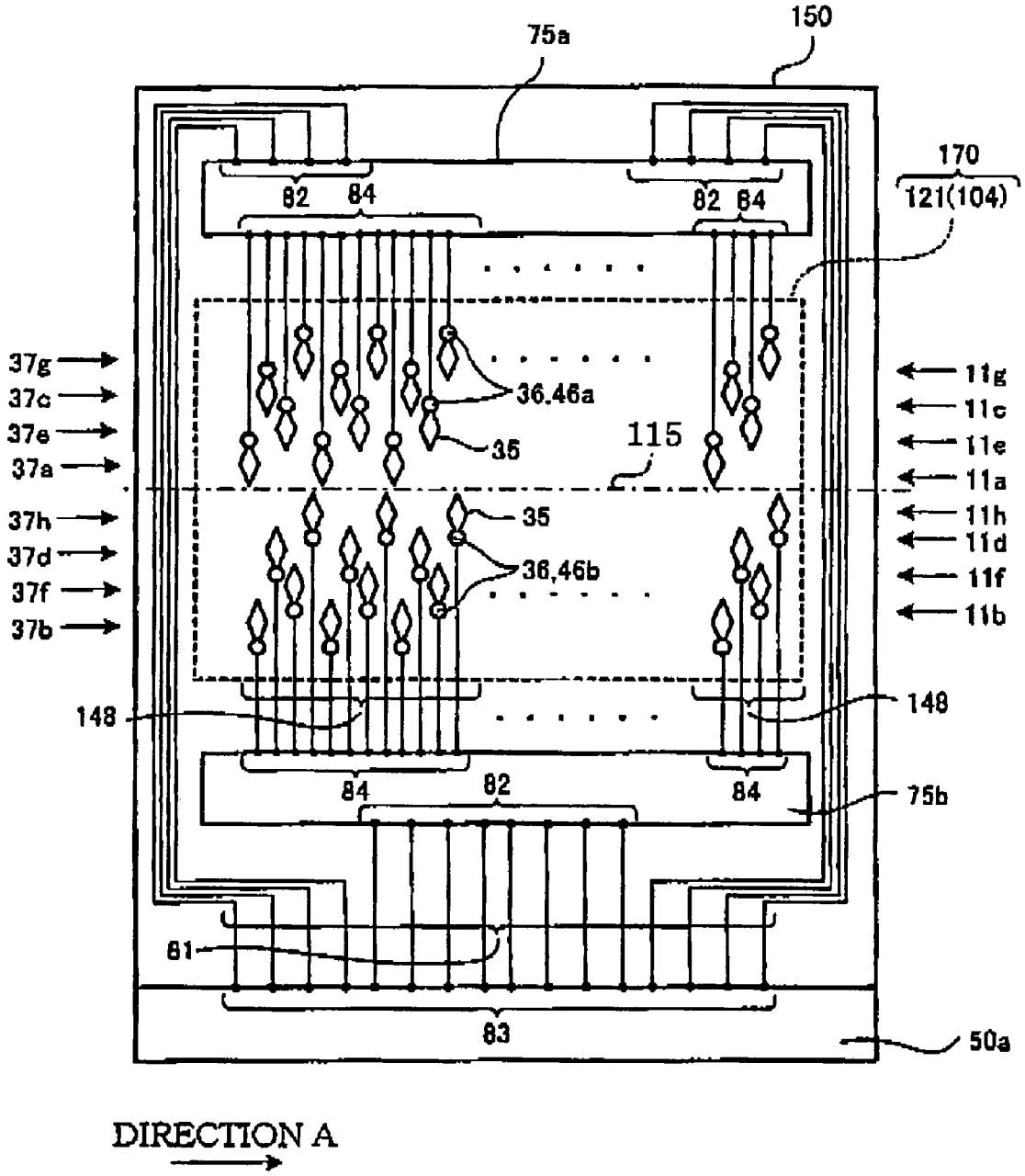
FIG. 16 is a view showing an arrangement of wires which are provided on a flexible printed circuit to connect an actuator unit and driver circuits in an inkjet head constructed according to a second embodiment of the invention.

Referring next to FIG. 16, there will be described an inkjet head constructed according to a second embodiment. In the following description, the same reference numerals as used in the first embodiment will be used to identify the same or similar elements, and redundant description of these elements will not be provided. FIG. 16 is a view showing an arrangement of wires provided on a FPC 150 to connect an actuator unit 121 and the driver ICs 75*a*, 75*b* in the inkjet head of the second embodiment.

While the inkjet head 1 of the above-described first embodiment is designed for performing a full color printing operation using the four color inks (magenta, yellow, cyan and black inks), the inkjet head of this second embodiment is designed for performing a mono-color printing operation using only a black ink. The inkjet head has a main body 170 including the actuator unit 121 and ink-passage defining unit 104. The FPC 150 is connected to the upper surface of the actuator unit 121.

<Construction of Ink-Passage Defining Unit>

The ink-passage defining unit 104 defines the multiplicity of pressure chambers 10 arranged in a total of eight rows 11 which extend in parallel to the manifold passages 5. The pressure chambers 10 are located to be adjacent to each other, and are arranged in a matrix establishing a zigzag pattern. It is note that the pressure chambers 10, manifold passages 5, vertically extending passages 7 and individual channels (constituted by the chambers 10, 5 and passages 7) have constructions substantially the same as those in the first embodiment, and accordingly redundant description of these constructions will not be provided.

The multiplicity of pressure chambers 10 arranged in the matrix cooperate to form the eight rows 11 each extending in the direction A, as shown in FIG. 16. The eight rows 11 are referred to as first, second, third, fourth, fifth, sixth, seventh and eighth pressure chamber rows 11*a*-11*h*, which are arranged in an order of 11*b*-11*f*-11*d*-11*h*-11*a*-11*e*-11*c*-11*g*, as viewed in a direction away from one of ends of the ink-passage defining unit 4 that are opposite to each other in the width direction of the unit 4 (in the primary scanning direction), toward the other end, namely, as viewed in an upward direction in FIG. 16. The nozzles 8 held in communication with the respective pressure chambers 10 are positioned relative to each other, such that any one of the nozzles 8 does not overlap with the other nozzle 8 as seen in a direction perpendicular to the direction A.

The ink-passage defining unit 4 is conceptually divided by an imaginary line 115 which extends in a longitudinal direction of the nozzle defining surface and which passes a center the nozzle defining surface as viewed in a width direction of the nozzle defining surface, into two regions, i.e., an upper region and a lower region which is located on a lower side of the upper region as seen in FIG. 16. Among the eighth pressure chamber rows 11*a*-11*h*, four rows 11*a*, 11*e*, 11*c*, 11*g* are located in the upper region while the other four rows 11*b*, 11*f*, 11*d*, 11*h* are located in the lower region. That is, the same number of pressure chamber rows are present in the upper and lower regions.

<Construction of Actuator Unit>

On the upper surface of the actuator unit 121, the multiplicity of individual electrodes 35 are arranged in a matrix, namely, according to the same pattern as the arrangement of the pressure chambers 10.

That is, the multiplicity of individual electrodes 35 arranged in a total of eight rows 37 which extend in the direction A as the rows 11 of the pressure chambers 10 of the ink-passage defining unit 104. The eight rows 37, extending in parallel to each other, are referred to as first, second, third, fourth, fifth, sixth, seventh and eighth individual electrode rows 37*a*-37*h* which correspond to the respective pressure chamber rows 11*a*-11*h*. It is noted that the actuator unit 121 is substantially the same as the actuator unit 21 of the first embodiment with respect to its construction and arrangement for the activation, and accordingly redundant description of the actuator unit 121 will not be provided.

<Connection of Actuator Unit and Driver ICs Via Wires in FPC>

The FPC 150 has substantially the same construction as the FPC 50 of the first embodiment, and accordingly redundant description thereof will not be provided. From each of the terminals 46*a* of the FPC 150, a drive wire (first drive wire) 148 extends toward the first driver IC 75*a* which is disposed in an upper portion of the FPC 150 as seen in FIG. 16. From each of the terminals 46*b* of the FPC 150, a drive wire (second drive wire) 148 extends toward the second driver IC 75*b* which is disposed in a lower portion of the FPC 150 as seen in FIG. 16. Therefore, the first drive wires 148 extending toward the first driver IC 75*a*, are not opposed or adjacent to the second drive wires 148 extending toward the second driver IC 75*b*.

The pressure chambers 10 are arranged such that the leftmost, second leftmost, third leftmost and fourth leftmost pressure chambers 10, as seen in FIG. 16, are provided by the pressure chambers 10 belonging to the rows 11*a*, 11*b*, 11*c*, 11*d*, respectively. In other words, the pressure chambers 10 are arranged in an order of 11*a*, 11*b*, 11*c*, 11*d*, as viewed in the longitudinal direction of the actuator unit 121 (recording medium feed direction) parallel to a scanning direction, away from a left end of the actuator unit 121 toward a right end of the unit 121 as seen in FIG. 16. Each of the pressure chambers rows 11*a*, 11*c*, 11*e*, 11*g* is located on the above-described upper region, and is constituted by odd-numbered ones of the pressure chambers 10 (as counted from the left end of the actuator unit 121, namely, as numbered on the basis of its distance from the left end as measured in the longitudinal direction). Meanwhile, each of the pressure chambers rows 11*b*, 11*d*, 11*f*, 11*h* is located on the above-described lower region, and is constituted by even-numbered ones of the pressure chambers 10. That is, the terminals 46*a* corresponding to the odd-numbered pressure chambers 10 are connected to the first driver IC 75*a* via the first drive wires 148, while the terminals 46*b* corresponding to the even-numbered pressure chambers 10 are connected to the second driver IC 75*b* via the second drive wires 148. In other words, the nozzles 8 corresponding to the terminals 46*a* and the nozzles 8 corresponding to the terminals 46*a* are alternately arranged as viewed in the recording medium feed direction.

As shown in FIG. 16, the connector terminals 83 are provided in the connected portion 50*a* which corresponds to a longitudinal end portion of the FPC 150, and are arranged in a row extending in a width direction of the FPC 150. The drive wires 148, connecting drive signal terminals 84 of the driver ICs 75*a*, 75*b* and the respective lands 36 of the actuator unit 121, is arranged to extend straight. The second controller wires 81, connecting the control signal terminals 82 of the second driver IC 75*b* and the respective connector terminals 83 of the connected portion 50*a*, is arranged to extend straight. The first controller wires 81, connecting the control signal terminals 82 of the first driver IC 75*a* and the respective connector terminals 83 of the connected portion 50*a*, is arranged to bypass or pass outside the first and second driver ICs 75*a*, 75*b* and then pass across a line which passes the second driver IC 75*b* and which is perpendicular to a line connecting the first and second driver ICs 75*a*, 75*b*, so as to connect the control signal terminals 82 and the respective connector terminals 83. This arrangement avoids the first controller wires 81 (connected to the first driver IC 75*a*) from passing among the terminals 46*a*, 46*b*. Thus, the first controller wires 81 are arranged to surround or bypass a drive wiring portion of the FPC 150 in which the drive wires 48 are disposed, without the controller wires 81 overlapping with the drive wiring portion, as viewed in the plan view.

In the inkjet head constructed according to the second embodiment, the first drive wires 148 connected to the first driver IC 75*a* are not opposed to the second drive wires 148 connected to the second driver IC 75*b*, and the first controller wires 81 connected to the first driver IC 75*a* are divided into two groups so as to surround the actuator unit 120, for extending toward the second driver IC 75*b*. This wiring arrangement permits the area of the FPC 150 and the pitch between each adjacent pair of the wires to be reduced and increased, respectively.

Further, the terminals 46*a* corresponding to the odd-numbered pressure chambers 10 are connected to the first driver IC 75*a* via the first drive wires 148, while the terminals 46*b* corresponding to the even-numbered pressure chambers 10 are connected to the second driver IC 75*b* via the second drive wires 148. Where there is some performance difference between the first and second driver ICs 75*a*, 75*b* arising from the manufacturing process, there would be variation in ink ejection characteristic. This alternate arrangement is effective to make such a variation less notable in an image formed in the recording medium in a printing operation.

While the presently preferred embodiments of the present invention have been described above in detail, it is to be understood that the invention is not limited to the details of the illustrated embodiments, but may be otherwise embodied.

For example, in the above-described first embodiment, the inkjet head 1 is formed with the four manifold passages serving as the common chambers. However, the number of the manifold passages may be more than four. Further, the number of the manifold passages does not have to be necessarily equal to the number of the pressure chamber groups. Further, the number of the rows constituting each of the pressure chamber groups is not particularly limited, as long as each pressure chamber group is constituted by at least one row.

While the first drive wires 48 (148) extending toward the first driver IC 75*a* are not opposed to the second drive wires 48 (148) extending toward the second driver IC 75*b* in the above-described embodiments, this arrangement is not essential. That is, the first drive wires 48 (148) extending toward the first driver IC 75*a* may be opposed to the second drive wires 48 (148) extending toward the second driver IC 75*b*, as long as the drive wires 48 (148) are arranged such that at least one of two conditions is satisfied, wherein one of the two conditions is that any one of the first drive wires 48 (148) connected to the first driver IC 75*a* does not reach one of the terminals 46*b* that is most distant from the first driver IC 75*a*, and the other condition is that any one of second drive wires 48 (148) connected to the second driver IC 75*b* does not reach one of the terminals 46*a* that is most distant from the second driver IC 75*b*. In other words, the first drive wires 48 (148) may be opposed to the second drive wires 48 (148), as long as the terminals 46 includes (i) a terminal 46 which is most distant from the first driver IC 75*a* among the terminals 46 and which is one of the terminals 46 connected to the second driver IC 75*b* via the second drive wires 48 (148), and/or (ii) a terminal 46 which is most distant from the second driver IC 75*b* among the terminals 46 and which is one of the terminals 46 connected to the first driver IC 75*a* via the first drive wires 48 (148).

Further, while the connector terminals 83 are disposed in an end portion of the FPC 50 (150) in the above-described embodiments, the connector terminals 83 may be disposed in a portion other than the end portion, and also may be disposed in a plurality of end portions of the FPC 50 (150).

Further, in the above-described first embodiment, the same number of terminal rows 56 and the same number of terminal groups 57 are disposed in the upper and lower regions which are located on opposite sides of the imaginary line 15. However, the number of the terminal rows 56 and/or the number of the terminal groups 57 disposed in the upper region may be different from those disposed in the lower region.

Further, while the FPC 50 (150) is fixedly bonded to the ink-passage defining unit 40 (140) through the attachment frame 86 interposed there between in the above-described embodiments, the FPC 50 (150) may be bonded directly to the ink-passage defining unit 40 (140) without the attachment frame 86, or the FPC 50 (150) may not be bonded to the ink-passage defining unit 40 (140).

In the above-described second embodiment, the inkjet head is designed such that the recording medium is to be fed in the longitudinal direction of the actuator unit 121, namely, in a scanning direction in which the inkjet head is operable to be reciprocated for performing a recording operation on the recording medium. However, the second embodiment may be modified such that the inkjet head is provided by an elongated head including a plurality of actuator units which are arranged to be contiguous to each other in the scanning direction. In this modified arrangement, for selecting the nozzles through which the ink is to be ejected, the head is operable to electrically scan in a direction perpendicular to the feed direction of the recording medium, without the head being moved or reciprocated. In this modified arrangement, too, it is possible to enjoy the above-described technical advantages.

In the above-described embodiments, the FPC 50 (150) is fixed to the frame 86 by applying the adhesive 87 to the portion of the frame 86 that surrounds the rectangular-shaped hole 86*a*. However, the FPC 50 (150) may be fixed to the frame 86 by introducing the adhesive through the though-holes 50*b* (which are formed in the portion of the FPC 50 (150) which is opposed to the above-described portion of the frame 86) toward the frame 86. In this case, the FPC 50 (150) is fixed, at its discrete portions aligned with the through-holes 50*b*, to the frame 86. Although the introduced adhesive is likely to somewhat expand on an interface between the FPC 50 (150) and the frame 68, there would be some portions between the adjacent through-holes 50*b*, which portions are not bonded. This bonding arrangement might be somewhat insufficient for preventing entrance of the ink and dust from the exterior of the inkjet head 1, but is sufficient for avoiding direct influence of an unnecessary external force upon the electric connections established on the actuator unit 21 (121), since the FPC 50 (150) is fixed, at at least the discrete portions aligned with the through-holes 50*b*, to the frame 86. Further, in this bonding arrangement, since the adhesive is introduced through the through-holes 50*b* toward the bonding surface (interface), the adhesive is solidified with the through-holes 50 being reliably filled with the adhesive. Thus, the FPC 50 (150) and the frame 86 can be bonded to each other with a bonding strength which is increased by, in addition to a direct adhesion there between, a so-called anchor effect which leads to an improved structural adhesion. Further, the bonding operation can be completed by simply introducing the adhesive into the through-holes 50*b* which are positioned above the above-describe portion of the frame 86 that surrounds the rectangular-shaped hole 86*a*. Although the bonding operation requires an additional process such as heating and irradiation, depending upon kind of the used adhesive, an external force is not applied to the bonded portion. The FPC 50 (150) and the frame 86 can be reliably fixed through the bonding operation which can be easily achieved, without risk of expansion of the applied adhesive toward a portion other than the predetermined bonded portion, which could impede operation of the actuator unit 21 (121).

Further, while the inkjet head is equipped with the actuator unit of piezoelectric type in the above-described embodiments, the inkjet head may be arranged such that the ink within each pressure chamber is heated in accordance with an ink-ejection requesting signal supplied from the FPC whereby the ink is given an ejection energy.

What is claimed is:

1. An inkjet head comprising:

(a) a passage defining unit having a plurality of nozzles and a plurality of pressure chambers held in communication with said nozzles;

(b) an actuator unit superposed on said passage defining unit and having a plurality of lands, such that said actuator unit is operable based on a drive signal supplied to each of said plurality of lands, to apply an ejection energy to an ink stored in a corresponding one of said pressure chambers of said passage defining unit;

(c) first and second driver circuits each having (c-1) a plurality of control signal terminals and (c-2) a plurality of drive signal terminals, such that a control signal can be input to each of said control signal terminals, and such that the drive signal generated based on the control signal can be output from each of said drive signal terminals; and (d) a flat cable on which said first and second driver circuits are disposed, wherein said flat cable has:

(d-1) a plurality of output terminals connected to said lands and located between said first and second driver circuits, said output terminals being disposed on said flat cable and being grouped into first output terminals and second output terminals;

(d-2) first drive wires connecting said first output terminals and said drive signal terminals of said first driver circuit;

(d-3) first controller wires extending from said control signal terminals of said first driver circuit;

(d-4) second drive wires connecting said second output terminals and said drive signal terminals of said second driver circuit;

(d-5) second controller wires extending from said control signal terminals of said second driver circuit, and (d-6) connector terminals located on one of opposite sides of said second driver circuit that is remote from said first driver circuit, such that said first and second controller wires extend to said connector terminals from said control signal terminals of said first and second driver circuits, and wherein said output terminals includes at least one of (i) a terminal which is most distant from said first driver circuit among said output terminals and which is one of said second output terminals, and (ii) a terminal which is most distant from said second driver circuit among said output terminals and which is one of said first output terminals.

2. The inkjet head according to claim 1, operable to scan in a scanning direction, for performing a recording operation on a recording medium that is to be fed in a feed direction perpendicular to the scanning direction, wherein said pressure chambers of said passage defining unit are arranged to lie on a plane, and wherein said actuator unit is fixed at one of opposite surfaces thereof to said passage defining unit, and has said lands disposed on the other of said opposite surfaces.

3. The inkjet head according to claim 1, wherein said output terminals are disposed on an output terminal portion of said flat cable which is located between said first and second driver circuits, and wherein said first controller wires extending from said control signal terminals of said first driver circuit to said connector terminals are arranged such that each of said first controller wires does not include a portion which overlaps with said output terminal portion of said flat cable as viewed in a direction in which said passage defining unit and said actuator unit are opposed to each other.

4. The inkjet head according to claim 1, wherein said output terminals are disposed on an output terminal portion of said flat cable which is located between said first and second driver circuits, and wherein said first controller wires extending from said control signal terminals of said first driver circuit to said connector terminals are arranged such that each of said first controller wires includes a portion which overlaps with said output terminal portion of said flat cable as viewed in a direction in which said passage defining unit and said actuator unit are opposed to each other.

5. The inkjet head according to claim 1, wherein said connector terminals are disposed on an end portion of said flat cable.

6. The inkjet head according to claim 1, operable to perform a recording operation on a recording medium that is to be fed in a feed direction, wherein said nozzles include first nozzles corresponding to said first output terminals, and second nozzles corresponding to said second output terminals, and wherein said first nozzles and second nozzles are alternately arranged as viewed in said feed direction.

7. The inkjet head according to claim 1, wherein said flat cable includes a first portion thereof located between said actuator unit and said first driver circuit, and a second portion thereof located between said actuator unit and said second driver circuit, and wherein said flat cable is bonded, at least said first portion and said second portion thereof to said passage defining unit.

8. The inkjet head according to claim 7, wherein said passage defining unit includes a frame portion surrounding said actuator unit which is superposed on said passage defining unit, and wherein said flat cable is bonded to said frame portion.

9. The inkjet head according to claim 8, wherein said frame portion is provided by a sheet having a thickness which is not smaller than a thickness of said actuator unit and which is not larger than a sum of said thickness of said actuator unit and 50 μm.

10. The inkjet head according to claim 9, wherein said actuator unit is sealed by said frame portion of said passage defining unit, said flat cable and an adhesive with which said flat cable and said frame portion are bonded to each other.

11. The inkjet head according to claim 1, wherein said inkjet head is divided by an imaginary line into first and second regions, and wherein said output terminals are grouped into said first and second output terminals, such that said first output terminals are located in said first region and include said terminal that is most distant from said second driver circuit among said output terminals, and such that said second output terminals are located in said second region and include said terminal that is most distant from said first driver circuit among said output terminals.

12. The inkjet head according to claim 11, operable to perform a recording operation on a recording medium that is to be fed in a feed direction, wherein said imaginary line is a straight line which extends in said feed direction, wherein said nozzles include first nozzles corresponding to said first output terminals, and second nozzles corresponding to said second output terminals, wherein said first nozzles are arranged in at least one row and located on one of opposite sides of said straight line, while said second nozzles are arranged in at least one row and located on the other of said opposite sides of said imaginary line, and wherein a difference between the number of said at least one row of said first nozzles and the number of said at least one row of said second nozzles is not larger than one.

13. The inkjet head according to claim 12, wherein said passage defining unit further has a plurality of common chambers held in communication with said pressure chambers, wherein said nozzles are grouped into a plurality of groups in each of which said nozzles are arranged in at least one row extending in said feed direction, and wherein said nozzles of each of said groups are held in communication with a corresponding one of said common chambers via said pressure chambers.

* * * * *